US009914307B2

(12) United States Patent
Kobayashi

(10) Patent No.: US 9,914,307 B2
(45) Date of Patent: Mar. 13, 2018

(54) LIQUID EJECTING APPARATUS AND MAINTENANCE METHOD OF LIQUID EJECTING APPARATUS

(71) Applicant: SEIKO EPSON CORPORATION, Tokyo (JP)

(72) Inventor: Satoru Kobayashi, Torrance, CA (US)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/365,618

(22) Filed: Nov. 30, 2016

(65) Prior Publication Data

US 2017/0151806 A1 Jun. 1, 2017

(30) Foreign Application Priority Data

Dec. 1, 2015 (JP) ..... 2015-234476
Dec. 18, 2015 (JP) ..... 2015-247612
Dec. 18, 2015 (JP) ..... 2015-247613

(51) Int. Cl.
*B41J 2/175* (2006.01)
*B41J 2/165* (2006.01)

(52) U.S. Cl.
CPC ..... *B41J 2/17596* (2013.01); *B41J 2/16535* (2013.01)

(58) Field of Classification Search
CPC ..... B41J 2/17596; B41J 2/16535
See application file for complete search history.

(56) References Cited

U.S. PATENT DOCUMENTS

2011/0193900 A1 8/2011 Aruga et al.
2012/0056933 A1 3/2012 Tanaka et al.
2012/0127242 A1* 5/2012 Koike ..... B41J 2/175 347/85
2015/0091977 A1 4/2015 Sugiura et al.

FOREIGN PATENT DOCUMENTS

| | | |
|---|---|---|
| JP | 10-129007 | 5/1998 |
| JP | 2009-178889 | 8/2009 |
| JP | 2011-173361 | 9/2011 |
| JP | 2012-051274 | 3/2012 |
| JP | 2013-121712 | 6/2013 |
| JP | 2015 030173 | 2/2015 |
| JP | 2015-066717 | 4/2015 |

OTHER PUBLICATIONS

European Search Report for Application No. 16201533.3 dated Apr. 26, 2017.

* cited by examiner

*Primary Examiner* — Henok Legesse
(74) *Attorney, Agent, or Firm* — Workman Nydegger

(57) ABSTRACT

A liquid ejecting apparatus includes a pressure adjustment mechanism including a liquid inflow portion, a liquid storage part in which an inner volume is changed depending on displacing of a diaphragm unit, a communication path which brings the liquid inflow portion and the liquid storage part into communication with each other, and an opening/closing valve which opens and closes the communication path; an opening valve mechanism which opens the opening/closing valve; a pressure mechanism which applies the pressure to the liquid; a wiping member which wipes a nozzle forming surface in which the nozzle is formed; and a control unit which is configured to open the opening/closing valve by the opening valve mechanism, applying the pressure to the liquid by the pressure mechanism to discharge the pressed liquid from the nozzle, and cause the wiping member to wipe the nozzle forming surface.

12 Claims, 14 Drawing Sheets

LIQUID EJECTING APPARATUS AND MAINTENANCE METHOD OF LIQUID EJECTING APPARATUS

BACKGROUND

1. Technical Field

The present invention relates to a liquid ejecting apparatus such as an ink jet printer or the like, and a maintenance method of the liquid ejecting apparatus.

2. Related Art

In the related art, as an example of a liquid ejecting apparatus, an ink jet printer which performs printing by ejecting an ink (liquid medium) supplied from an ink tank (liquid supply source) onto a medium from an ink jet head (liquid ejecting unit) is known. In the printers, a printer including a damper (pressure adjustment mechanism) for adjusting a pressure of an ink to be supplied to the ink jet head is included (for example, refer to JP-A-2009-178889).

The damper includes an ink path (communication path) which brings a tank-side liquid chamber (liquid inflow portion) and a head-side chamber (liquid storage unit) into communication with each other and a valve (opening/closing valve) which opens and closes the ink path. The valve is configured to open the valve according to a pressure in a pressure variable chamber in which the head-side chamber and a flexible film (diaphragm unit) are formed at a distance. That is, the valve of the ink path is open when the pressure in the tank-side liquid chamber increases to a predetermined value or more than the pressure in the pressure variable chamber.

For example, in a case of performing so-called pressure cleaning in which an ink is supplied under the pressure from the ink tank into the ink jet head and is discharged from the nozzle, it is required to open the valve of the damper, forcibly. That is, in a case of performing pressure cleaning, it is required to maintain a valve-open state that the pressure is continuously applied into a pressure variable chamber.

In the above-described printer, when performing the pressure cleaning, since the volume of the head-side chamber becomes greater in accordance with the open vale after the pressure cleaning, there is a problem in that an ink, which is attached around a nozzle opening in an ink jet head, is absorbed in the nozzle with foreign matters or bubbles.

This problem is not limited to the ink jet printer which performs printing by ejecting an ink from a nozzle and also applies to a liquid ejecting apparatus including a pressure adjustment mechanism adjusting the pressure of the liquid.

SUMMARY

An advantage of some aspects of the invention is to provide a liquid ejecting apparatus which can suppress that a liquid which is attached around a nozzle opening in a nozzle forming surface absorbed in the nozzle with foreign matters or bubbles, after performing pressure cleaning which supplies a pressed liquid to a liquid ejecting unit to discharge the supplied liquid from the nozzle, forcibly, and a maintenance method of the liquid ejecting apparatus.

Hereinafter, means of the invention and operation effects thereof will be described.

A liquid ejecting apparatus includes a liquid supply path which is capable of supplying a liquid to a liquid ejecting unit which ejects the liquid from a nozzle by driving an actuator from a liquid supply source; a pressure adjustment mechanism which is provided on the liquid supply path and includes a liquid inflow portion for causing entry of the liquid to be supplied from the liquid supply source, a liquid storage part which is capable of storing the liquid internally, and in which an inner volume is changed depending on displacing of a diaphragm unit, a communication path which brings the liquid inflow portion and the liquid storage part into communication with each other, and an opening/closing valve in which a state is switched from a valve-close state which is a non-communication state between the liquid inflow portion and the liquid storage part in the communication path to a valve-open state which is a communication state between the liquid inflow portion and the liquid storage part, when the pressure to be applied to a first surface which is an inner surface of the liquid storage part in the diaphragm unit is lower than a pressure to be applied to a second surface which is an outer surface of the liquid storage part in the diaphragm unit, and the difference between the pressure to be applied to the first surface and the pressure to be applied to the second surface is equal to or more than a predetermined valve; a pushing mechanism which is configured to place the opening/closing valve into the valve-open state by pressing the diaphragm unit in a direction in which the volume of the liquid storage part is reduced; a pressure mechanism which is capable of pressing the liquid to be supplied to the pressure adjustment mechanism; a wiping member which is capable of wiping a nozzle forming surface in which the nozzle is formed in the liquid ejecting unit; and a control unit which is configured to open the opening/closing valve by pushing the diaphragm unit by the pushing mechanism, supply the liquid which is in a pressed state which is obtained by causing the pressure mechanism to apply the pressure to the liquid to discharge the supplied liquid from the nozzle to the liquid ejecting unit so as to cause the wiping member to wipe the nozzle forming surface.

According to the configuration, by performing wiping of the nozzle forming surface by the wiping member after performing pressure cleaning which supplies the liquid pressed by the pressure mechanism to the liquid ejecting unit to forcibly discharge the liquid from the nozzle, a meniscus can be formed in the nozzle. Therefore, a liquid, which is attached around a nozzle opening in the nozzle forming surface, is suppressed from being absorbed in the nozzle with foreign matters or bubbles, after performing the pressure cleaning.

In the liquid ejecting apparatus, it is preferable that the pressure mechanism be capable of applying a pressure to a predetermined amount of the liquid, and the control unit be configured to supply the predetermined amount of the liquid in a pressed state which is obtained by pressing the predetermined amount of the liquid by the pressure mechanism to the liquid ejecting unit, to cause the wiping member to wipe the nozzle forming surface after the discharging of the liquid from the nozzle is stopped, and to open the opening/closing valve by causing the pushing mechanism to release the pushed state of the diaphragm unit.

In general, when a predetermined amount of the pressed liquid is discharged from the nozzle, a level of the pressure of the liquid to be supplied in accordance with the discharging of the liquid is lowered and becomes a pressure level at which the liquid is not discharged from the nozzle. In this state, the meniscus is formed in the nozzle in a higher inner pressure state than the inner pressure of the liquid ejecting unit at the time of normal meniscus formation by wiping the nozzle forming surface through the wiping member, thereby in a case where the inner pressure of the liquid ejecting unit is lowered by an opening/closing operation of the opening/ closing valve, it can be suppressed that the meniscus in the nozzle is broken and the air or the like is sucked in the nozzle.

In the liquid ejecting apparatus, it is preferable that the control unit be configured to discharge the liquid in a pressed state which is obtained by causing the pressure mechanism to apply the pressure to the liquid to the liquid ejecting unit from the nozzle, and to wipe the nozzle forming surface by the wiping member after stopping the supply of the liquid in a pressed state to the liquid ejecting unit by closing the opening/closing valve by releasing the pressed state of the diaphragm unit by the pushing mechanism.

According to the configuration, when closing the opening/closing valve during discharging of the pressed liquid from the nozzle, the liquid in a pressed state of the liquid ejecting unit even after opening the opening/closing valve is discharged from the nozzle, and it becomes a pressure level at which the liquid is not discharged from the nozzle. In this state, the meniscus can be formed in the nozzle in a higher inner pressure state than the inner pressure of the liquid ejecting unit at the time of normal meniscus formation by wiping the nozzle forming surface through the wiping member. Therefore, in a case where the inner pressure of the liquid ejecting unit is lowered by the opening/closing operation of the opening/closing valve, it can be suppressed that the meniscus in the nozzle is broken and the air or the like is sucked in the nozzle.

In the liquid ejecting apparatus, it is preferable that a cap which is capable of capping a region including the nozzle of the liquid ejecting unit be further included, and the control unit be configured to supply the liquid in the pressed state which is obtained by causing the pressure mechanism to apply the pressure to the liquid to the liquid ejecting unit to discharge the supplied liquid from the nozzle, to stop the discharging of the liquid from the nozzle, to release a capping state of the region due to the cap, to cause the wiping member to wipe the nozzle forming surface.

According to the configuration, when the liquid is discharged from the nozzle in a state where the region including the nozzle of the liquid ejecting unit is capped with the cap, since the pressure in the cap is increased, a resistance that impedes the discharging of the liquid from the nozzle is generated. Therefore, the pressure level when the liquid is not discharged from the nozzle becomes greater than a case where the region is not capped. In this state, the air or the like is sucked in the nozzle, even when the capping state due to the cap is released. Thereafter, the meniscus can be formed in the nozzle in a higher inner pressure state than the inner pressure of the liquid ejecting unit at the time of normal meniscus formation by wiping the nozzle forming surface through the wiping member. Therefore, in a case where the inner pressure of the liquid ejecting unit is lowered by the opening/closing operation of the opening/closing valve, it can be suppressed that the meniscus in the nozzle is broken and the air or the like is sucked in the nozzle.

In the liquid ejecting apparatus, it is preferable that the cap include an atmosphere releasing valve which is capable of switching between a communication state where an enclosed region which is formed when the region is capped is communicated with an air and a non-communication state where the enclosed region is not communicated with the air, and, when releasing a certain period of time during discharging of the liquid from the nozzle and the capping state of the region due to the cap, the control unit be configured to switch a state of the atmosphere releasing valve from the communication state to the non-communication state.

According to the configuration, by discharging the liquid from the nozzle in the communication state of the atmosphere releasing valve and a state where the region including the nozzle of the liquid ejecting unit is capped with the cap, and by switching the atmosphere releasing valve to the non-communication state in the middle, the pressure in the cap can be changed. That is, by changing the timing for switching the atmosphere releasing valve from the communication state to the non-communication state, the degree of an increase in the pressure in the cap can be adjusted.

A maintenance method of a liquid ejecting apparatus which includes a liquid supply path which is capable of supplying a liquid to a liquid ejecting unit which ejects the liquid from a nozzle by driving an actuator from a liquid supply source; a pressure adjustment mechanism which is provided on the liquid supply path and includes a liquid inflow portion for causing entry of the liquid to be supplied from the liquid supply source, a liquid storage part which is capable of storing the liquid internally, and in which an inner volume is changed depending on displacing of a diaphragm unit, a communication path which brings the liquid inflow portion and the liquid storage part into communication with each other, and an opening/closing valve in which a state is switched from a valve-close state which is a non-communication state between the liquid inflow portion and the liquid storage part in the communication path to a valve-open state which is a communication state between the liquid inflow portion and the liquid storage part, when the pressure to be applied to a first surface which is an inner surface of the liquid storage part in the diaphragm unit is lower than a pressure to be applied to a second surface which is an outer surface of the liquid storage part in the diaphragm unit, and the difference between the pressure to be applied to the first surface and the pressure to be applied to the second surface is equal to or more than a predetermined valve; a pushing mechanism which is configured to place the opening/closing valve into the valve-open state by pressing the diaphragm unit in a direction in which the volume of the liquid storage part is reduced; a pressure mechanism which is capable of pressing the liquid to be supplied to the pressure adjustment mechanism; a wiping member which is capable of wiping a nozzle forming surface in which the nozzle is formed in the liquid ejecting unit; and a control unit which is configured to open the opening/closing valve by pushing the diaphragm unit by the pushing mechanism, supply the liquid which is in a pressed state which is obtained by causing the pressure mechanism to apply the pressure to the liquid to discharge the supplied liquid from the nozzle so as to cause the wiping member to wipe the nozzle forming surface, in which the opening/closing valve is open by pushing the diaphragm unit by the pushing mechanism and the nozzle forming surface is wiped by the wiping member after supplying the liquid which is pressed by the pressure mechanism to the liquid ejecting unit and discharging the supplied liquid from the nozzle.

According to the configuration, by performing wiping of the nozzle forming surface by the wiping member after performing pressure cleaning which supplies the liquid pressed by the pressure mechanism to the liquid ejecting unit to forcibly discharge the liquid from the nozzle, a meniscus can be formed in the nozzle. Therefore, a liquid, which is attached around a nozzle opening in the nozzle forming surface, is suppressed from being absorbed in the nozzle with foreign matters or bubbles, after performing the pressure cleaning.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a liquid ejecting apparatus will be described with reference to drawings.

Figure 1:
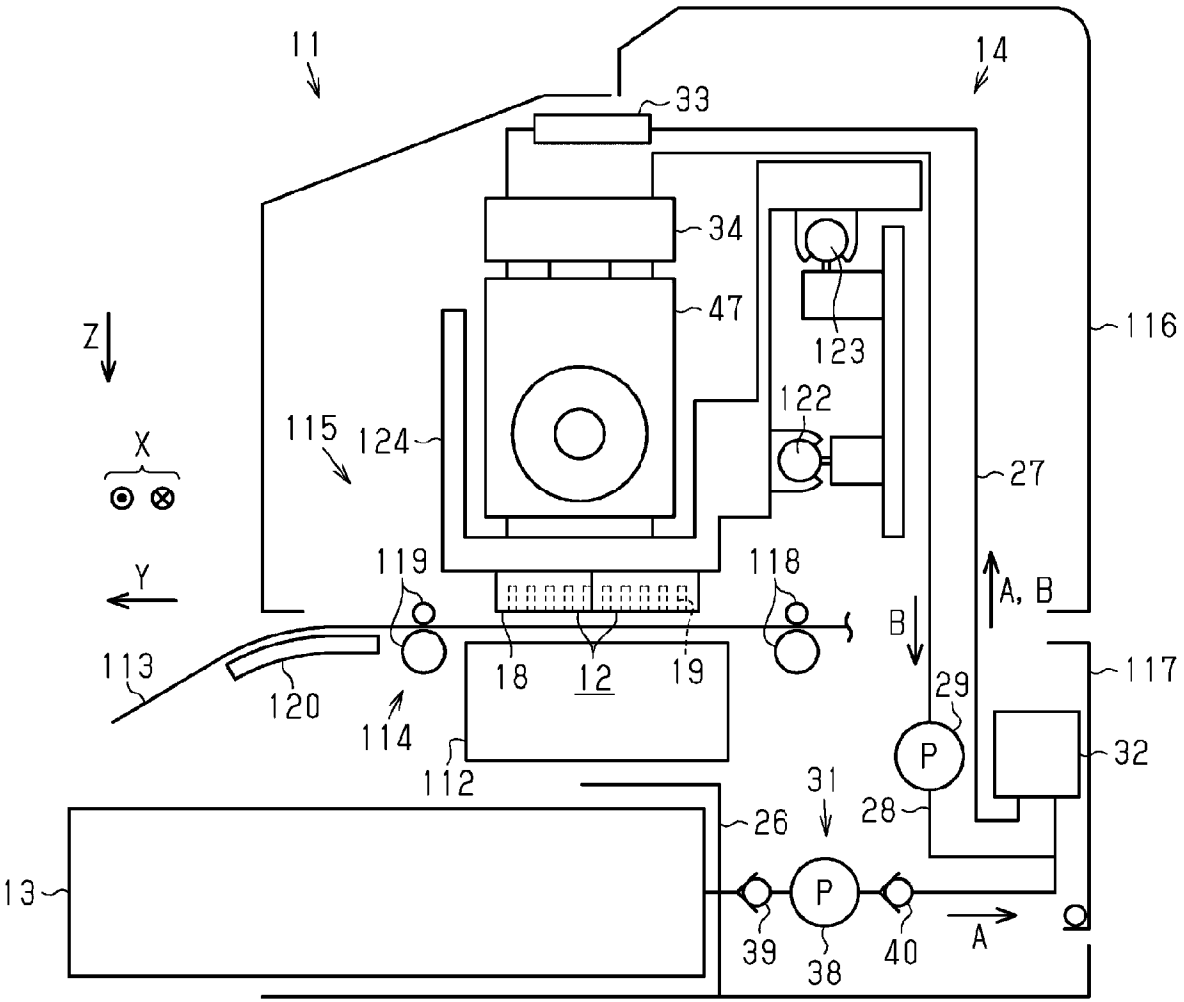
FIG. 1 is a schematic diagram of a liquid ejecting apparatus of a first embodiment.

As illustrated in FIG. 1, a liquid ejecting apparatus 11 such as an ink jet printer or the like includes a liquid ejecting unit 12 which ejects a liquid such as an ink, and a supply mechanism 14 which supplies the liquid to the liquid ejecting unit 12 from a liquid supply source 13. Furthermore, the liquid ejecting apparatus 11 includes a support base 112 which is disposed in a position facing the liquid ejecting unit 12, a transporting unit 114 which transports a medium 113 such as a sheet or the like in a transporting direction Y, and a printing unit 115 which performs printing by ejecting a liquid onto the medium 113 while moving the liquid ejecting unit 12 in a scanning direction X.

The support base 112 is extended to the medium 113 in a width direction (scanning direction X) that is a direction perpendicular (cross) to the transporting direction Y of the medium 113. The support base 112, the transporting unit 114, and the printing unit 115 are mounted on a main body 116 which is configured of housing, a frame, or the like. A cover 117 is openably/closably provided on the main body 116.

The transporting unit 114 includes a pair of transporting rollers 118 and 119 which is disposed at an upstream side and a downstream side of the support base 112, respectively, in the transporting direction Y, and a guide plate 120 which is disposed at the downstream side of the pair of the transporting rollers 119 and which guides the medium 113. When the pair of the transporting rollers 118 and 119 are driven by a transporting motor (not illustrated) and rotated while pinching the medium 113, the medium 113 is supported by the support base 112 and the guide plate 120 and is transported along the surface of the support base 112 and the surface of the guide plate 120.

The printing unit 115 includes guide shafts 122 and 123 which are extended along the scanning direction X and a carriage 124 which is guided to the guide shafts 122 and 123 and which is moveable reciprocally in the scanning direction X. The carriage 124 is moved in accordance with the driving of a carriage motor (not illustrated). At least one (two in the present embodiment) of the liquid ejecting units 12 is attached at the lower end portion that is an end of the carriage 124 in a vertical direction Z side. Two liquid ejecting units 12 are disposed at a predetermined distance in the scanning direction X and are disposed so as to shift at the predetermined distance in the transporting direction Y. Each liquid ejecting unit 12 ejects the liquid from a plurality of nozzles 19 which are formed on a nozzle forming surface 18.

Figure 2:
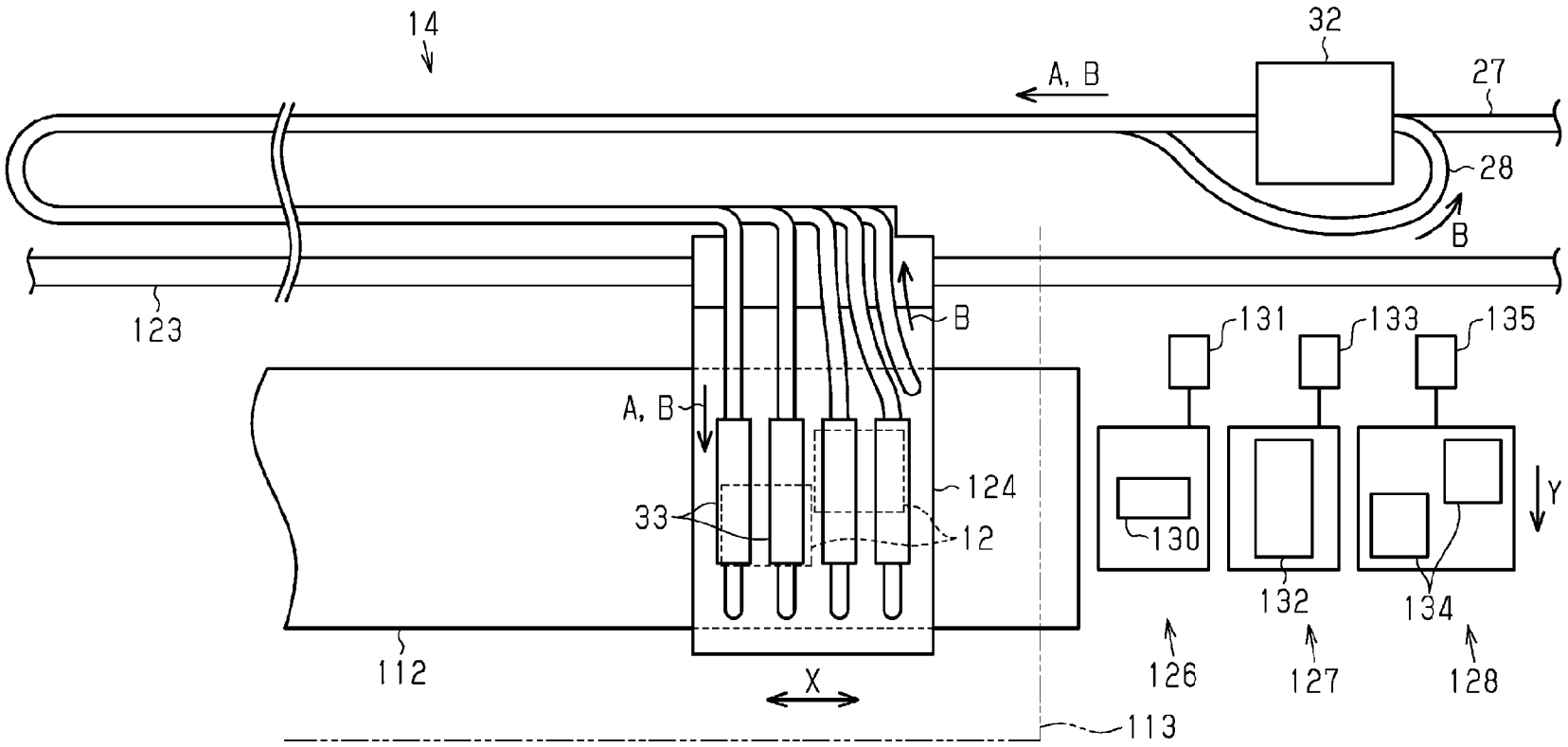
FIG. 2 is a schematic plan view of a printing region and a non-printing region.

As illustrated in FIG. 2, a wiper unit 126, a blushing unit 127, and a cap unit 128 are provided in a non-printing region in which the liquid ejecting unit 12 is not confronted with the medium 113 during transporting in the scanning direction X. The wiper unit 126 includes a swivable wiping member 130 which is capable of wiping the nozzle forming surface 18 and a wiping motor 131 to be used as a power source of the wiping member 130.

The wiping member 130 can be configured by a fabric wiper or a rubber blade, for example. The wiping member 130 of the present embodiment is configured by the fabric wiper, and performs wiping of the nozzle forming surface 18 while moving along the transporting direction Y by driving the wiping motor 131 in a state where the liquid ejecting unit 12 is moved in a place where the wiping can be performed by the wiping member 130.

The blushing unit 127 includes a liquid receiving unit 132 receiving the liquid which is ejected from the nozzle 19 of the liquid ejecting unit 12 by the blushing. The liquid receiving unit 132 is configured by a swivable belt and is moved by electric power of a blushing motor 133. The blushing means an operation for ejecting (discharging) the liquid, forcibly, for the purpose of preventing and releasing clogging of the nozzle 19 or the like, with no relation to the printing from the entire nozzles 19.

The cap unit 128 includes two rectangular box-like caps 134 for covering the opening of each nozzle 19 of two liquid ejecting units 12 and a capping motor 135 for raising the cap 134. By raising two caps 134 by driving the capping motor 135 in a state where two liquid ejecting units 12 is moved in a position facing two caps 134, respectively, a so-called capping in which two caps 134 are in contact with the nozzle forming surface 18 of two liquid ejecting unit 12 so as to cover entire the nozzle 19 is performed. That is, each cap 134 is capable of capping the region including entire the nozzle 19 in the nozzle forming surface 18 of each liquid ejecting unit 12.

Figure 3:
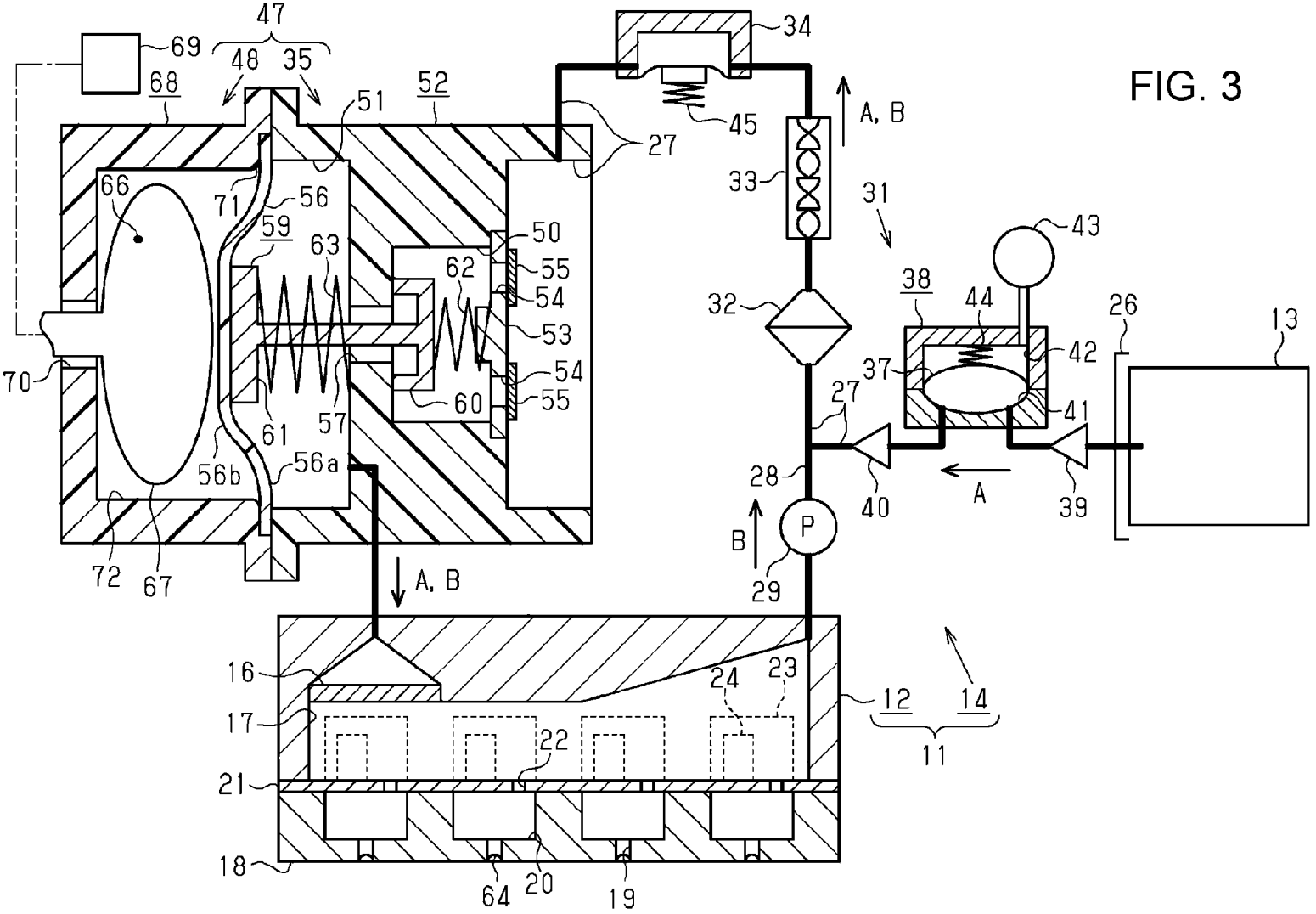
FIG. 3 is a schematic view of a pressure adjustment device and a supply mechanism in a state where the opening/closing valve is open.

As illustrated in FIG. 3, the liquid ejecting unit 12 includes an ejecting unit filter 16 for trapping bubbles or foreign matters in the liquid and a common liquid chamber 17 for storing the liquid which has passed through the ejecting unit filter 16. Furthermore, the liquid ejecting unit 12 includes a plurality of pressure chambers 20 which allows the plurality of nozzles 19 and the common liquid chamber 17 which are formed in the nozzle forming surface 18. A part of wall surfaces of the pressure chamber 20 is formed by a vibrating plate 21 and the common liquid chamber 17 and the pressure chamber 20 are communicated with each other through a communication hole 22. Furthermore, an actuator 24 which is stored in a storing chamber 23 is disposed in a position different from a position of the common liquid chamber 17 that is a surface opposite to the portion facing the pressure chamber 20 in the vibrating plate 21.

The actuator 24 of the present embodiment is configured by a piezoelectric element which is contracted in a case where a driving voltage is applied. When the driving voltage is applied to the actuator 24 after the vibrating plate 21 is deformed in accordance with the contraction of the actuator 24 due to the application of the driving voltage, the liquid in the pressure chamber 20 in which the volume is changed is ejected from the nozzle 19 as a liquid droplet. That is, the liquid ejecting unit 12 ejects the liquid from the nozzle 19 by driving the actuator 24.

The liquid supply source 13 is a storage container which is capable of storing the liquid, for example, may be a cartridge for supplying the liquid by displacing the storage container and a storing tank which is fixed in a mounting unit 26. In a case where the liquid supply source 13 is a cartridge, the mounting unit 26 detachably holds the liquid supply source 13. At lease a set (in the present embodiment, four sets) of the liquid supply source 13 and the supply mechanism 14 is provide for each type of the liquid to be ejected from the liquid ejecting unit 12.

In addition, the supply mechanism 14 includes a liquid supply path 27 which is capable of supplying the liquid to the liquid ejecting unit 12 which is positioned at an upstream side of the liquid in a supplying direction A and at a downstream side from the liquid supply source 13. A part of the liquid supply path 27 serves as a circulating path in cooperated with a circulating path forming unit 28. That is, the circulating path forming unit 28 is connected to the common liquid chamber 17 and the liquid supply path 27. A circulating pump 29 for circulating the liquid in the circulating path in a circulating direction B is provided in the circulating path forming unit 28.

A pressure mechanism 31 for pressing and supplying the liquid toward the liquid ejecting unit 12 by flowing the liquid from the liquid supply source 13 in the supplying direction A is provided in the liquid supply source 13 side positioned rather than a position in which the circulating path forming unit 28 is connected in the liquid supply path 27. Furthermore, in a portion which is serves as the circulating path at the downstream side than a position where the circulating path forming unit 28 is connected in the liquid supply path 27, a filter unit 32, a static mixer 33, a liquid storing unit 34, and a pressure adjustment mechanism 35 are provided in order from the upstream side.

The pressure mechanism 31 includes a displacement pump 38 which is capable of pressing a predetermined amount of the liquid by reciprocating a flexible member 37 having flexibility and one-way valves 39 and 40 which are proved at the upstream side and the downstream side of the displacement pump 38 in the liquid supply path 27, respectively. The displacement pump 38 includes a pump chamber 41 and a negative pressure chamber 42 which are separated by a flexible member 37. Furthermore, the displacement pump 38 includes a decompression unit 43 for decompressing the negative pressure chamber 42 and an urging member 44 for pulling the flexible member 37 which is provided in the negative pressure chamber 42 toward the pump chamber 41 side.

In addition, the one-way valves 39 and 40 permit the flowing of the liquid from the upstream side to the downstream side in the liquid supply path 27 and inhibit the liquid from the downstream side to the upstream side. That is, the pressure mechanism 31 is capable of pressing the liquid to be supplied to the pressure adjustment mechanism 35 by pulling the liquid in the pump chamber 41 through the flexible member 37 by the urging member 44. Therefore, pressure force pressing the liquid by the pressure mechanism 31 is set by urging force of the urging member 44.

The filter unit 32 traps the bubbles and the foreign matters in the liquid and is exchangeably provided. The static mixer 33 causes a change such as direction converting or dividing of a flow of the liquid and reduces a polarization of the concentration in the liquid. The liquid storing unit 34 stores the liquid in a variable volume space which is pulled by a spring 45 and relieves the variation of the pressure in the liquid.

Next, a pressure adjustment device 47 will be described.

As illustrated in FIG. 3, the pressure adjustment device 47 includes the pressure adjustment mechanism 35 which is provided in the liquid supply path 27 and configures a part of the liquid supply path 27 and a pushing mechanism (opening valve mechanism) 48 for pushing the pressure adjustment mechanism 35. The pressure adjustment mechanism 35 includes a main body portion 52 including a liquid inflow portion 50 in which the liquid supplied from the liquid supply source 13 to the liquid supply path 27 is flown and a liquid storage unit 51 (a liquid storage part) which is capable of storing the liquid in the inner portion.

The liquid supply path 27 and the liquid inflow portion 50 are partitioned by a wall portion 53 and are communicated with each other by a through hole 54 which is formed in the wall portion 53. The through hole 54 is covered with a filter member 55. Accordingly, a liquid in the liquid supply path 27 is filtered by the filter member 55 and flows into the liquid inflow portion 50.

In the liquid storage unit 51, a part of the will surface is configured by a diaphragm unit 56. The diaphragm unit 56 receives a pressure of the liquid in the liquid storage unit 51 at a first surface 56*a* that is an inner surface of the liquid storage unit 51 and receives an atmosphere pressure at a second surface 56*b* that is an outer surface of the liquid storage unit 51. Therefore, the diaphragm unit 56 is displaced according to the pressure in the liquid storage unit 51. Accordingly, the volume of the liquid storage unit 51 is changed by displacing of the diaphragm unit 56. The liquid inflow portion 50 and the liquid storage unit 51 are communicated with each other by a communication path 57.

The pressure adjustment mechanism 35 includes an opening/closing valve 59 which is capable of switching a valve-close state (a state illustrated in FIG. 3) to be switched to a non-communication state between the liquid inflow portion 50 and the liquid storage unit 51 in the communication path 57 and a valve-open state (a state illustrated in FIG. 5) to be switched to a communication state between the liquid inflow portion 50 and the liquid storage unit 51. The opening/closing valve 59 includes a valve portion 60 which is capable of shielding of the communication path 57 and a pressure receiving portion 61 which receives the pressure from the diaphragm unit 56 and is moved by pushing the diaphragm unit 56 by the pressure receiving portion 61. That is, the pressure receiving portion 61 serves as a moveable moving member in a state where the pressure receiving portion 61 is in contact with the diaphragm unit 56 displacing to a direction in which the volume of the liquid storage unit 51 is reduced.

An upstream side-urging member 62 is provided in the liquid inflow portion 50 and a downstream side-urging member 63 is provided in the liquid storage unit 51. Any of the upstream side-urging member 62 and the downstream side-urging member 63 is pulled in a direction for closing the opening/closing valve 59. When a pressure to be applied in the first surface 56*a* is lower than the pressure to be applied in the second surface 56*b* and a difference between the pressure applied to the first surface 56*a* and the pressure to be applied in the second surface 56*b* is equal to or more than a predetermined value (for example, 1 kPa), the state of the opening/closing valve 59 is switched from the valve-close state to the valve-open state.

The predetermined valve is a valve determined in accordance with urging force of the upstream side-urging member 62, urging force of the downstream side-urging member 63, force required for displacing the diaphragm unit 56, pushing force (sealing load) required for shielding the communication path 57 by the valve portion 60, a pressure in the liquid inflow portion 50 to be acted in a surface of the valve portion 60, and a pressure in the liquid storage unit 51. That is, the urging force of the upstream side-urging member 62 and the downstream side-urging member 63 is greater than the predetermined valve as the urging force becomes greater.

The urging force of the upstream side-urging member 62 and the downstream side-urging member 63 is set such that the pressure in the liquid storage unit 51 becomes a negative pressure state in a range in which the pressure in the liquid storage unit 51 is capable of forming a meniscus 64 in an air-liquid interface in the nozzle 19 (for example, in a case where the pressure applied to the second surface 56*b* is an atmosphere, −1 kPa). In this case, the air-liquid interface means an interface in which the liquid is in contact with the air, and the meniscus 64 is a curved liquid surface which is formed by contacting with the nozzle 19. It is preferable that the concave shaped meniscus 64 which is suitable for the injection of the liquid be formed in the nozzle 19.

The pushing mechanism (opening valve mechanism) 48 includes an expansion and contraction unit 67 which forms a pressure adjustment chamber 66 in the second surface 56*b* of the diaphragm unit 56, a pressing member 68 for pressing the expansion and contraction unit 67, and a pressure adjustment unit 69 which is capable of adjusting the pressure in the pressure adjustment chamber 66. The expansion and contraction unit 67 is formed into a balloon shape by a rubber or a resin, for example, and is expanded and contracted in accordance with the adjustment of the pressure of the pressure adjustment chamber 66 by the pressure adjustment unit 69. The pressing member 68 is formed into a bottomed cylindrical shape and a part of the expansion and contraction unit 67 is communicated with an inserting hole 70 which is formed in a bottom portion.

An edge portion at an opening 71 side of the inner side surface in the pressing member 68 has an R-chamfered shape and is rounded. The pressing member 68 is attached to the pressure adjustment mechanism 35 such that the opening 71 is blocked to the pressure adjustment mechanism 35, there by an air chamber 72 for covering the second surface 56*b* of the diaphragm unit 56 is formed. The pressure in the air chamber 72 is set as an atmosphere pressure and the atmosphere pressure is acted on the second surface 56*b* of the diaphragm unit 56.

That is, the pressure adjustment unit 69 expansions the expansion and contraction unit 67 by adjusting a pressure in the pressure adjustment chamber 66 to a pressure higher than the atmosphere pressure that is a pressure in the air chamber 72. By expanding the expansion and contraction unit 67 by the pressure adjustment unit 69, the pushing mechanism 48 pushes the diaphragm unit 56 in a direction in which the volume of the liquid storage unit 51 is reduced. In this time, the expansion and contraction unit 67 of the pushing mechanism 48 pushes the region where the pressure receiving portion 61 is contacted in the diaphragm unit 56. The volume of the region in which the pressure receiving portion 61 is contacted in the diaphragm unit 56 becomes a greater than the cross-section area of the communication path 57.

Figure 4:
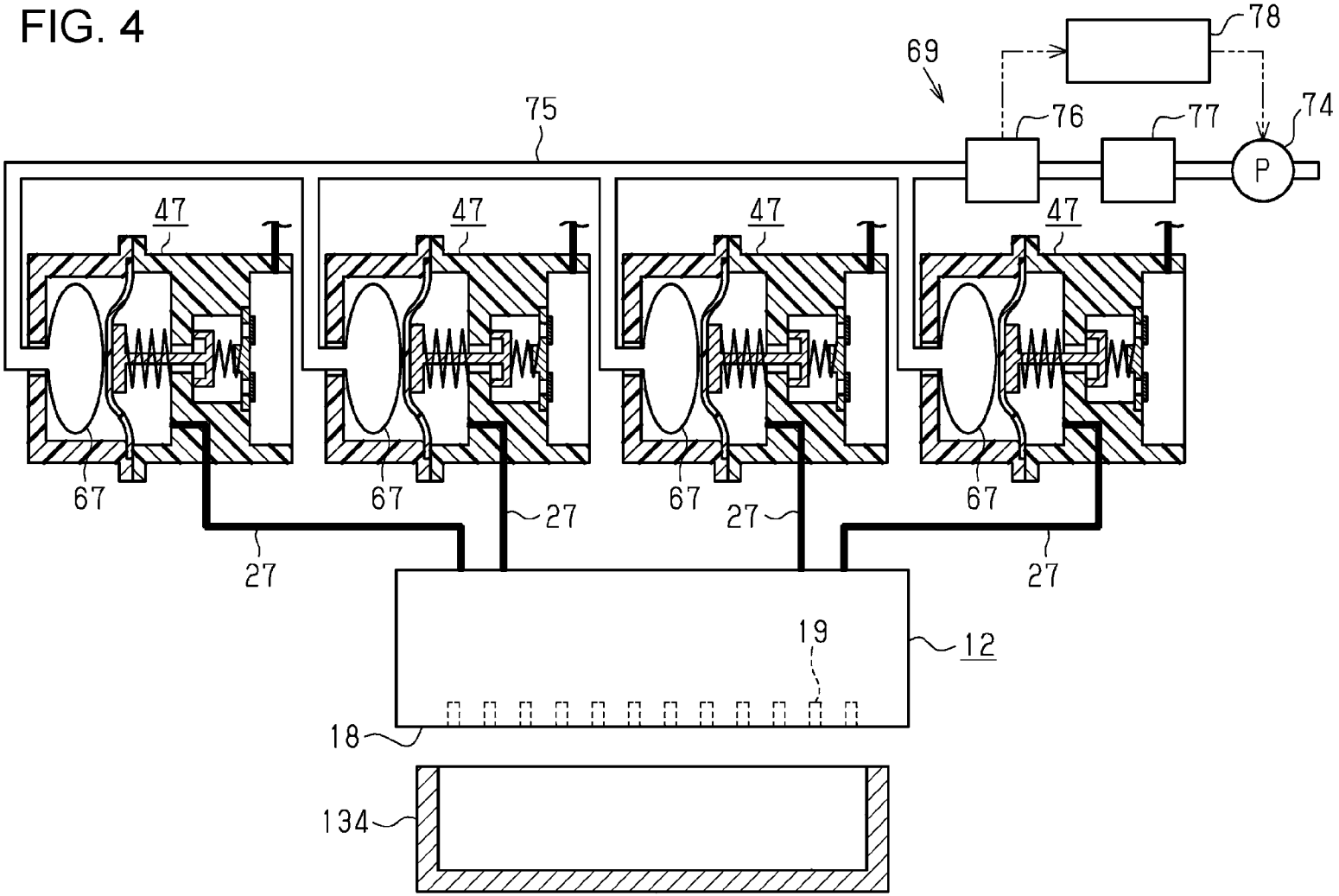
FIG. 4 is a schematic view of a plurality of pressure adjustment devices and pressure adjustment units.

As illustrated in FIG. 4, the pressure adjustment unit 69 includes a pressure pump 74 which presses the liquid such as air or water, for example, a connecting path 75 which connects the pressure pump 74 and the expansion and contraction unit 67, and a detecting unit 76 and a liquid pressure adjustment unit 77 which are provided in the connecting path 75. A plurality (in the present embodiment, four) of branches are provided at the downstream side of the connecting path 75, and are connected to the expansion and contraction unit 67 of the plurality (in the present embodiment, four) of pressure adjustment devices 47, respectively. By providing a switching valve which switches a state between the communication state and the non-communication state of the flow path to the flow path of the connecting path 75 which is branched into a plurality of paths, the pressed liquid can be selectively supplied to the plurality of expansion and contraction units 67.

That is, the liquid pressed by the pressure pump 74 is supplied to the expansion and contraction unit 67, respectively, through the connecting path 75. The detecting unit 76 detects the pressure of the liquid in the connecting path 75 and the liquid pressure adjustment unit 77 is configured by a safety valve, for example. In a case where the pressure of the liquid in the connecting path 75 is greater than the predetermined pressure, by automatically opening the valve and discharging the liquid in the connecting path 75 to the outside, the liquid pressure adjustment unit 77 reduces the pressure of the liquid in the connecting path 75.

In addition, the liquid ejecting apparatus 11 includes a control unit 78 for controlling a driving of the pressure pump 74 based on the pressure of the liquid in the connecting path 75 which is detected by the detecting unit 76. The control unit 78 controls the entire the liquid ejecting apparatus 11, integrally, and controls a driving of various mechanisms, various motors, various pumps or the like, for example.

Next, an action of the pressure adjustment device 47 for adjusting a pressure of the liquid to be supplied to the liquid ejecting unit 12 will be described.

Figure 5:
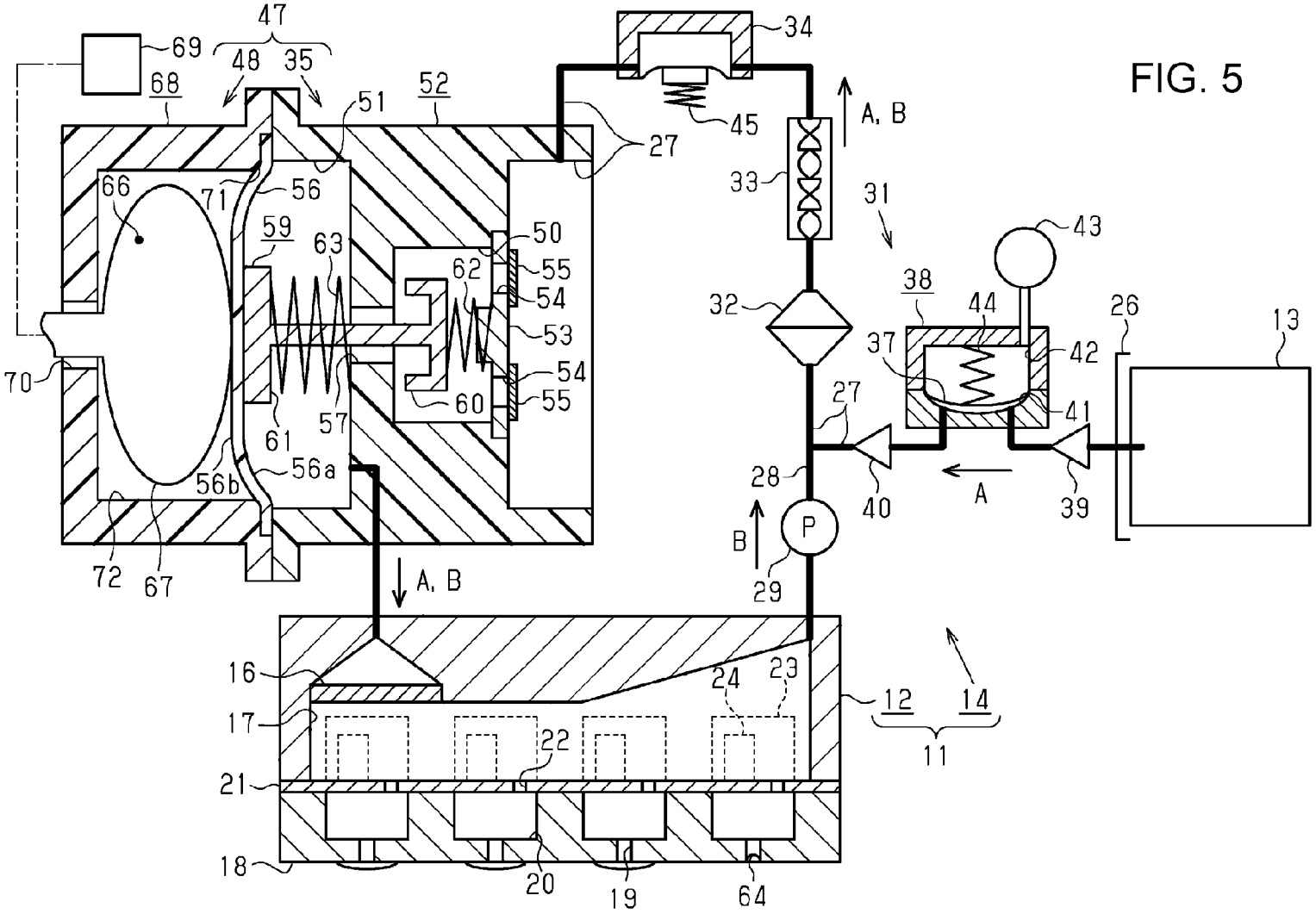
FIG. 5 is a schematic view of the pressure adjustment device and the supply mechanism in a state where the opening/closing valve is closed.

As illustrated in FIG. 3, when the liquid ejecting unit 12 ejects the liquid, the liquid stored in the liquid storage unit 51 is supplied to the liquid ejecting unit 12 through the liquid supply path 27. In this manner, as illustrated in FIG. 5, when the pressure in the liquid storage unit 51 is reduced and the difference between the pressure to be applied on the first surface 56*a* in the diaphragm unit 56 and the pressure to be applied to the second surface 56*b* is equal to or more than the predetermined value, the diaphragm unit 56 is bent and deformed in a direction in which the volume of the liquid storage unit 51 is reduced. When the pressure receiving portion 61 is pushed and moved in accordance with a deformation of the diaphragm unit 56, the state of the opening/closing valve 59 is switched to the valve-open state.

In this manner, since the liquid in the liquid inflow portion 50 is pressed by the pressure mechanism 31, the liquid is supplied from the liquid inflow portion 50 to the liquid storage unit 51 and the pressure in the liquid storage unit 51 is increased. Accordingly, the diaphragm unit 56 is deformed such that the volume of the liquid storage unit 51 is increased. When the difference between the pressure to be applied to the first surface 56*a* in the diaphragm unit 56 and the pressure to be applied in the second surface 56*b* is smaller than the predetermined value, the opening/closing valve 59 inhibits the flow of the liquid by switching the state from the valve-open state to the valve-close state.

In this manner, the pressure adjustment mechanism 35 adjusts the pressure of the liquid to be supplied to the liquid ejecting unit 12 by displacing the diaphragm unit 56 thereby the pressure in the liquid ejecting unit 12 that is a back pressure of the nozzle 19 is adjusted.

Next, an action in a case where in order to maintenance of the liquid ejecting unit 12, pressure cleaning is performed by forcibly flowing the liquid from the liquid supply source 13 to the liquid ejecting unit 12.

As illustrated in FIG. 4, when the control unit 78 drives the pressure pump 74, the liquid to be suppressed to the expansion and contraction unit 67 is supplied. In this manner, as illustrated in FIG. 5, the expansion and contraction unit 67 to which the liquid is supplied is expanded and pushes the region in which the pressure receiving portion 61 in the diaphragm unit 56 is contacted thereby the opening/closing valve 59 is in a valve-open state.

That is, the pushing mechanism 48 as the opening valve mechanism moves the pressure receiving portion 61 against to the urging force of the upstream side-urging member 62 and the downstream side-urging member 63, the state of the opening/closing valve 59 is switched to the valve-open state. In this case, since the pressure adjustment unit 69 is connected to the expansion and contraction unit 67 of the plurality of pressure adjustment devices 47, entire the opening/closing valves 59 of the pressure adjustment devices 47 is in the valve-open state.

In this case, since the diaphragm unit 56 is deformed in a direction in which the volume of the liquid storage unit 51 is reduced, the liquid stored in the liquid storage unit 51 is extracted to the liquid ejecting unit 12 side. That is, the diaphragm unit 56 pushes the liquid storage unit 51 and the pressure is transmitted to the liquid ejecting unit 12 thereby the meniscus 64 is broken and the liquid is leaked from the nozzle 19. That is, the pushing mechanism 48 pushes the diaphragm unit 56 such that the pressure in the liquid storage unit 51 becomes greater than the pressure (a pressure at the liquid side in the air-liquid interface is a pressure higher at 3 kPa than the pressure at the air side) in which at least one of the meniscuses 64 is broken.

In addition, the pushing mechanism 48 pushes the diaphragm unit 56 thereby the state of the opening/closing valve 59 becomes a valve-open state regardless of the pressure in the liquid inflow portion 50. In this case, the pushing mechanism 48 pushes the diaphragm unit 56 by the pushing force greater than the pushing force to be generated in a case where the pressure in which the above-describe predetermined valve is added to the pressure to be applied to the liquid by the pressure mechanism 31 is added to the diaphragm unit 56.

In the valve-open state of the opening/closing valve 59 by pushing the diaphragm unit 56 by the pushing mechanism 48, the control unit 78 periodically drives the decompression unit 43 thereby the liquid pressed by the pressure mechanism 31 is supplied to the liquid ejecting unit 12. That is, when the pressure of the negative pressure chamber 42 is reduced in accordance with the driving of the decompression unit 43, the flexible member 37 is moved in a direction in which the volume of the pump chamber 41 becomes increased.

In this manner, the liquid is flown from the liquid supply source 13 to the pump chamber 41. When the pressure is released by the decompression unit 43, the flexible member 37 is pulled in a direction in which the volume of the pump chamber 41 decreases by the urging force of the urging member 44. That is, the liquid in the pump chamber 41 is pressed by the urging force of the urging member 44 through the flexible member 37 and is supplied to the downstream side of the liquid supply path 27 through the one-way valve 40 which is disposed at the downstream side.

Since the pushing mechanism 48 maintain the valve-open state of the opening/closing valve 59 during pushing the diaphragm unit 56, when the pressure mechanism 31 presses the liquid in this state, the pressure force is transmitted to the liquid ejecting unit 12 through the liquid inflow portion 50, the communication path 57, and the liquid storage unit 51, and the pressure cleaning in that the liquid is discharged from the nozzle 19 is performed.

In a case where the pressure cleaning is finished, the control unit 78 controls the state of the opening/closing valve 59 to the valve-close state by releasing the pushed state of the diaphragm unit 56 by the pushing mechanism 48, in state where the liquid is pressed by the pressure mechanism 31. In this case, the control unit 78 moves the actuator 24 of the liquid ejecting unit 12 in a process in which the state of the opening/closing valve 59 is switched from the valve-open state to the valve-close state.

That is, when the actuator 24 is driven, since the liquid is ejected from the nozzle 19, and the ejected liquid is supplied from the liquid storage unit 51 to the liquid ejecting unit 12, the opening/closing valve 59 is closed in a state where the liquid is flown from the liquid inflow portion 50 to the liquid storage unit 51. Thereafter, the control unit 78 performs blushing by driving the actuator 24 after wiping the nozzle forming surface 18 to the wiping member 130. Accordingly, the meniscus 64 is formed in the nozzle 19.

Next, a manufacturing method for manufacturing the pressure adjustment device 47 by bonding the pressure adjustment mechanism 35 to the pushing mechanism 48 will be described.

Firstly, the main body portion 52 of the present embodiment is formed by a light absorbing resin which absorbs laser light to emit the heat (for example, polypropylene or polybutylene terephthalate) or a resin colored with a pigment which absorbs the light. In addition, the diaphragm unit 56 is formed by attaching the different materials such as polypropylene or polybutylene terephthalate, and has transmittivity and flexibility for transmitting the laser light. The pressing member 68 is formed by a light transmitting resin which transmits the laser light (for example, polystyrene or polycarbonate). That is, the degree of the transparency of the diaphragm unit 56 is higher than the degree of the transparency of the main body portion 52 and lower than the degree of the transparency of the pressing member 68.

As illustrated in FIG. 3, firstly, the diaphragm unit 56 is pinched by the main body portion 52 and the pressing member 68 in which a part of the expansion and contraction unit 67 is inserted into the inserting hole 70 (pinching process). The laser light is radiated through the pressing member 68 (radiating process). In this manner, the main body portion 52 absorbs the laser light which has passed through the pressing member 68 and emits the heat. By the heat generated in this time, the main body portion 52, the diaphragm unit 56, and the pressing member 68 are welded. Accordingly, when manufacturing the pressure adjustment device 47, the pressing member 68 serves as a jig for pressing the diaphragm unit 56.

Hereinabove, according to the detailed described first embodiment, the following effects can be obtained.

(1) The pushing mechanism 48 can be switched to the valve-open state of the opening/closing valve 59 regardless of the pressure in the liquid inflow portion 50, even when the pressure in the liquid inflow portion 50 is varied. Therefore, the liquid can be stably supplied to the liquid ejecting unit 12.

(2) By adjusting the pressure in the pressure adjustment chamber 66, the pressure adjustment unit 69 pushes the diaphragm unit 56 in a direction in which the volume of the liquid storage unit 51 is reduced. Therefore, the pushing mechanism 48 can appropriately perform the pushing of the diaphragm unit 56.

(3) By inflating the expansion and contraction unit 67, the pressure adjustment unit 69 pushes the diaphragm unit 56 in a direction in which the volume of the liquid storage unit 51 is reduced. Therefore, the pushing mechanism 48 can appropriately perform the pushing of the diaphragm unit 56.

(4) When performing the pressure cleaning in which the liquid which is pressed and supplied from the liquid supply source 13 side is discharged from the nozzle 19, the liquid is pressed and supplied at a pressure higher than the pressure in which the meniscus 64 is broken. In this point, in the present embodiment, since the pressure in the liquid storage unit 51 in which the diaphragm unit 56 is pushed by the pushing mechanism 48 is higher than the pressure in which the meniscus 64 is broken, the opening/closing valve 59 can be switched to the valve-open state even in a case of performing the pressure cleaning.

(5) Since the pushing mechanism 48 pushes the region in which the pressure receiving portion 61 is contacted in the diaphragm unit 56, the deformation of the diaphragm unit 56 can be limited compared to a case where the pressure adjustment mechanism 35 does not have the pressure receiving portion 61. Accordingly, in a case where the pushing mechanism 48 releases the pushing of the diaphragm unit 56 and the diaphragm unit 56 is displaced in a direction in which the volume of the liquid storage unit 51 becomes greater, a possibility that the liquid or the like is sucked in the nozzle 19 can be reduced.

(6) In a state where the opening/closing valve 59 is open, by supplying the liquid which is pressed by the pressure mechanism 31 to the liquid ejecting unit 12, cleaning of the liquid ejecting unit 12 can be appropriately performed.

(7) Since the diaphragm unit 56 which is pushed by the pushing mechanism 48 set the opening/closing valve 59 in the valve-open state by displacing in a direction in which the volume of the liquid storage unit 51 is reduced, when the pushing of the pushing mechanism 48 is released, the diaphragm unit 56 is displaced in a direction in which the volume of the liquid storage unit 51 becomes greater. In this case, since the liquid which is pressed by the pressure mechanism 31 is supplied to the pressure adjustment mechanism 35, a possibility that the liquid is sucked from the liquid ejecting unit 12 side can be reduced.

Accordingly, a possibility that the liquid or the like is sucked in the nozzle 19 can be reduced.

(8) By driving the actuator 24, the liquid ejecting unit 12 ejects the liquid which is supplied from the liquid supply source 13 from the nozzle 19. That is, since the liquid is flown from the liquid supply source 13 side toward the liquid ejecting unit 12 side, a possibility that the liquid or the like is sucked in the nozzle 19 can be reduced.

(9) The opening/closing valve 59 can be switched to the valve-open state regardless of the pressure of the liquid inflow portion 50. Accordingly, for example, in a case where the pressure of the liquid inflow portion 50 when performing a recording process to the medium 113 by ejecting the liquid from the nozzle 19 becomes increased, the liquid can be supplied to the liquid ejecting unit 12 by switching the opening/closing valve 59 to the valve-open state. Accordingly, an interruption of the recording process or a deterioration in a recording quality associated with the interruption of the recording process.

(10) Since the liquid pressure adjustment unit 77 is provided in the connecting path 75, the pressure of the liquid to be supplied to the expansion and contraction unit 67 can be adjusted, even in a case where the pressure of the connecting path 75 is increased by unexpected driving of the pressure pump 74. Accordingly, a possibility that the unexpected pressure is applied to the expansion and contraction unit 67 can be reduced.

(11) By performing the wiping and blushing after switching the opening/closing valve 59 from the valve-open state to the valve-close state, the meniscus 64 can be arranged. For example, in a case where the diaphragm unit 56 is moved in a direction in which the volume of the liquid storage unit 51 is increased, the meniscus 64 can be arranged, even in a case where the region in which the pressure receiving portion 61 is not contacted is moved in a direction in which the volume of the liquid storage unit 51 is reduced and the liquid is leaked from the nozzle 19.

Second Embodiment

Next, a second embodiment of a liquid ejecting apparatus will be described with reference with the drawings.

Figure 6:
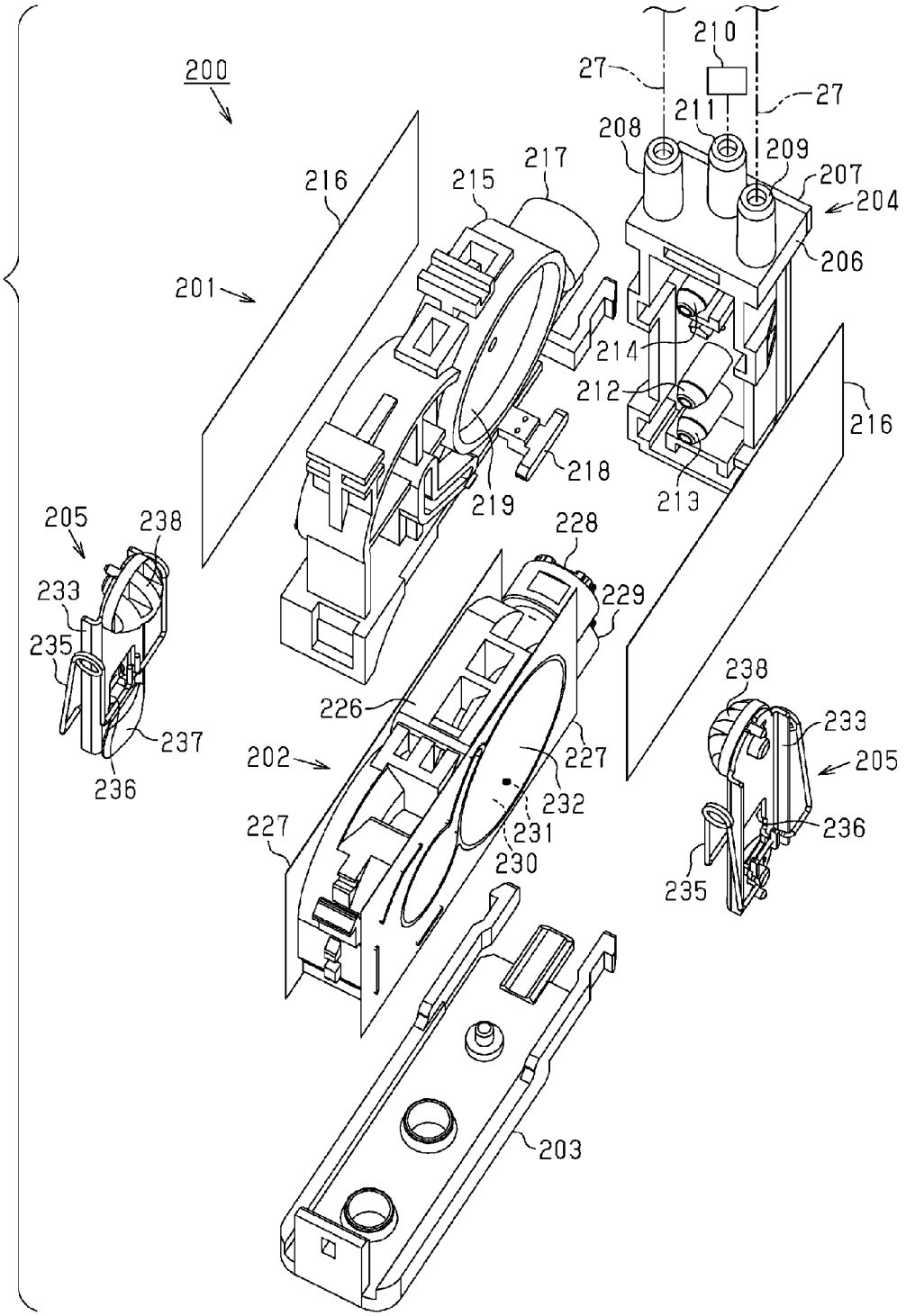
FIG. 6 is an exploded perspective view of a pressure adjustment device of a second embodiment.
Figure 7:
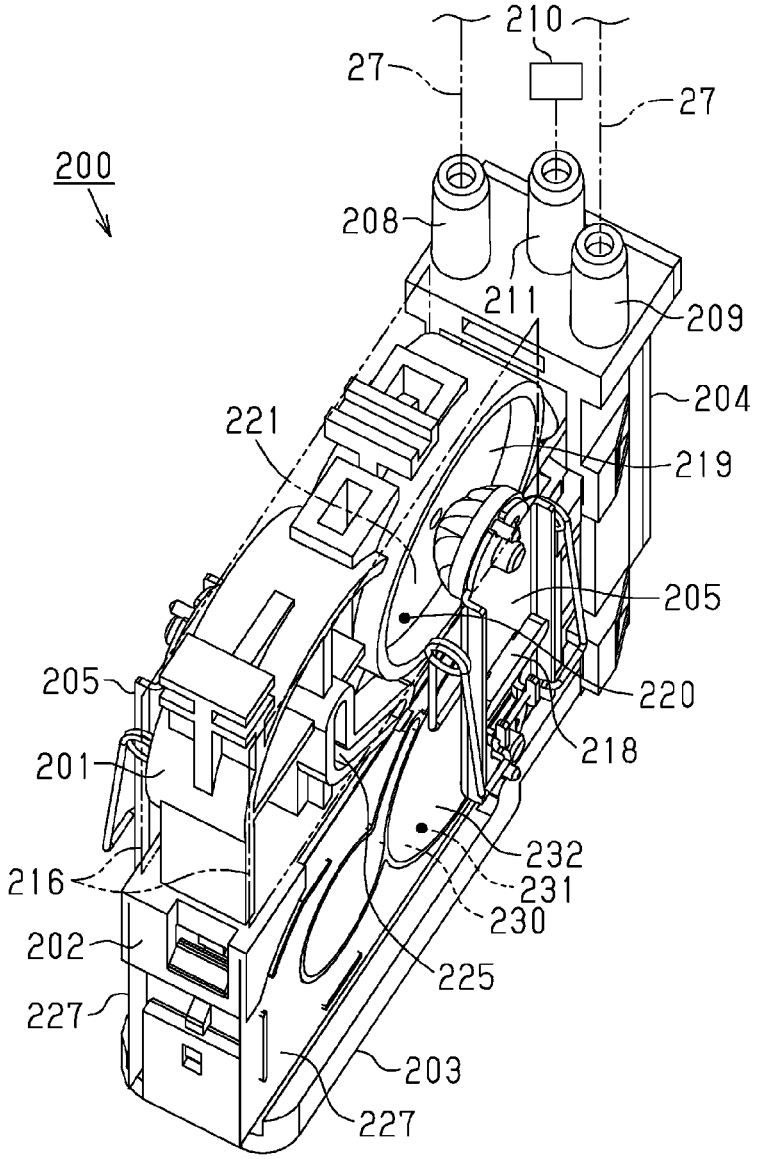
FIG. 7 is a perspective view of the pressure adjustment device.

In the second embodiment is an embodiment in which the pressure adjustment device 47 in the above first embodiment is changed to the pressure adjustment device 200 illustrated in FIGS. 6 and 7. In the other feature, since it is the same as the first embodiment, the same reference numerical is given to the same member, and the explanation about the reference numerical is not provided.

As illustrated in FIGS. 6 and 7, the pressure adjustment device 200 is formed of an assembly of an air chamber forming unit 201, a pressure adjustment mechanism forming unit 202, a bottom plate member 203, a connection unit forming unit 204, and two lever units 205.

The connection unit forming unit 204 includes a main body portion 206 and a connecting film 207 which is attached so as to cover the outer side surface of the main body portion 206. Two first liquid connection portion 208 and second liquid connection portion 209 to be connected to each other among the plurality of liquid supply paths 27 and a pressure connection portion 211 in which a pressure adjustment unit 210 are projected on the upper surface of the main body portion 206. A first liquid lead-out portion 212, a second liquid lead-out portion 213, and a pressure supply portion 214 which are communicated with the first liquid connection portion 208, the second liquid connection portion 209, and the pressure connection portion 211 are projected to an inner side surface of the main body portion 206.

Three grooves (not illustrated) are formed in the outer side surface of the main body portion 206 of the connection unit forming unit 204 and three flow paths (not illustrated) are formed by three grooves and the connecting film 207. These three flow paths (not illustrated) are connected to the first liquid connection portion 208, the second liquid connection portion 209 and the pressure connection portion 211, and the first liquid lead-out portion 212, and the second liquid lead-out portion 213, and the pressure supply portion 214, respectively.

The air chamber forming unit 201 includes a main body portion 215 and a flexible air chamber film 216 which is attached to the both side surfaces so as to cover the entire both side surfaces of the main body portion 215. An air introduction portion 217, to which the pressure supply portion 214 is connected, is provided in the side surface of the connection unit forming unit 204 side in the main body portion 215. A substantially T-shaped attachment portion 218 in which the lever unit 205 is attached is projected to the vicinity of the boundary of the pressure adjustment mechanism forming unit 202 in the both side surfaces of the main body portion 215, respectively.

Figure 8:
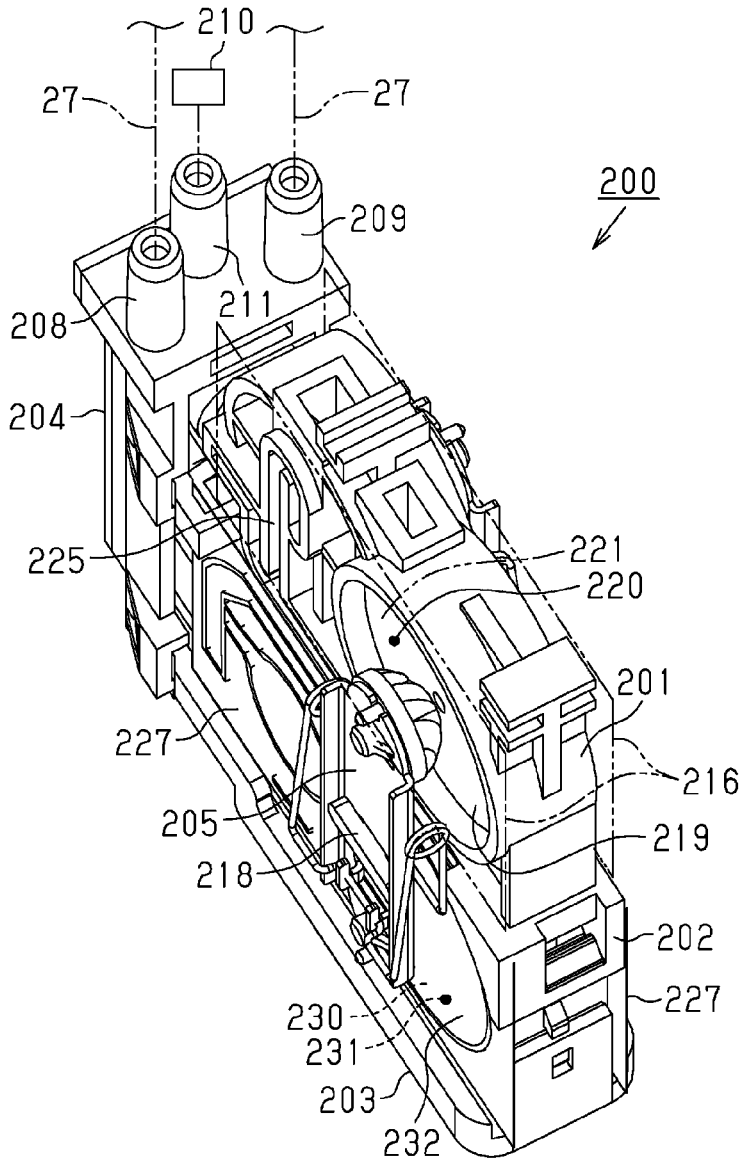
FIG. 8 is a perspective view of FIG. 7 when viewed from a different angle.

As illustrated in FIGS. 6 and 8, a circular concave portion 219 formed in the both side surfaces of the main body portion 215 of the air chamber forming unit 201, respectively. A space surrounded by the concave portion 219 and the air chamber film 216 is set as a pressure adjustment chamber 220 that is an air chamber. A circular portion corresponding to the concave portion 219 in each air chamber film 216 is set as a flexible wall 221 which forms a part of the pressure adjustment chamber 220. In the present embodiment, a rotating force applying portion is configured by the flexible wall 221.

Figure 9:
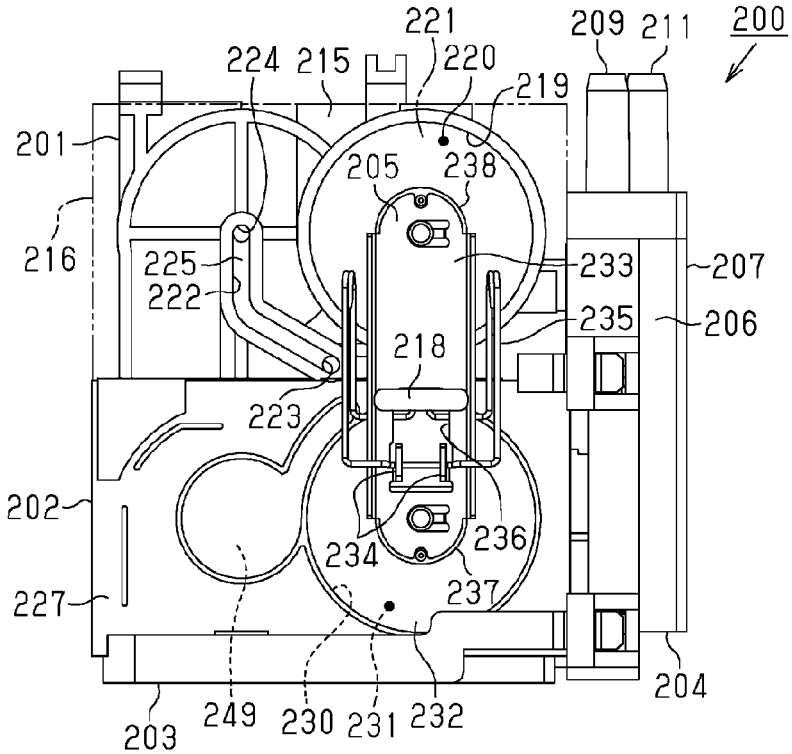
FIG. 9 is a side view of FIG. 7.
Figure 10:
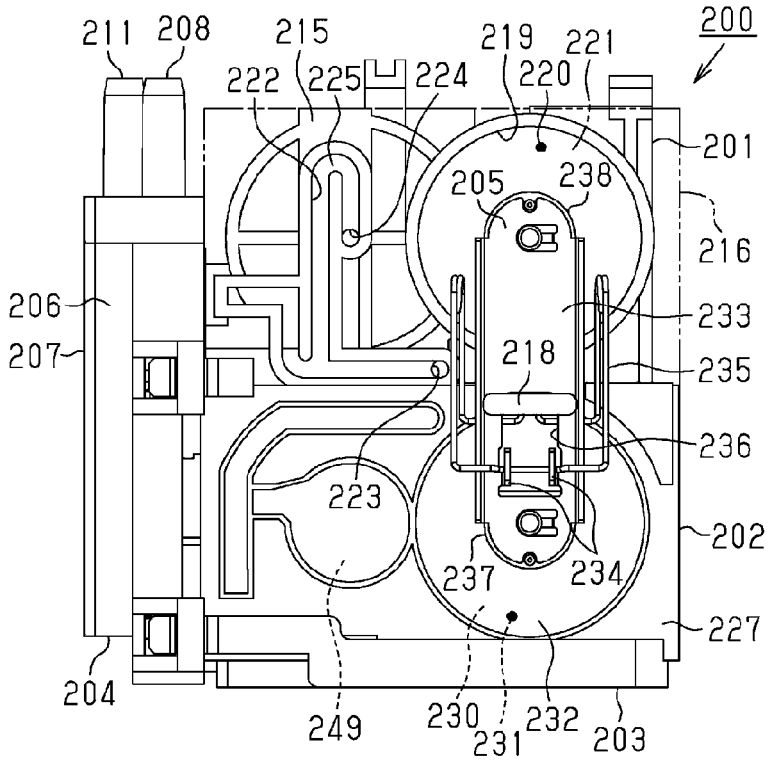
FIG. 10 is a side view of FIG. 9 when viewed from the opposite side.

As illustrated in FIGS. 9 and 10, a groove 222 is formed in the both side surfaces of the main body portion 215 of the air chamber forming unit 201, respectively, and the grooves 222 are communicated with a through hole 223. Two grooves 222 are communicated to the center portion of the concave portion 219 which is positioned at the facing side through a through hole 224. An air flow path 225 is formed by a space surrounded by two grooves 222 and two air chamber films 216. Therefore, the air flow path 225 is extended over the both side surfaces of the main body portion 215. The air flow path 225 is communicated with the air introduction portion 217.

As illustrated in FIG. 6, the pressure adjustment mechanism forming unit 202 includes a main body portion 226 and a flexible pressure film 227 which is attached to the both side surfaces so as to cover entire both side surfaces of the main body portion 226. A first liquid lead-in portion 228 and a second liquid lead-in portion 229 in which the first liquid lead-out portion 212 and the second liquid lead-out portion 213 are connected, respectively, are provided in the side surface of the connection unit forming unit 204 side in the main body portion 226.

As illustrated in FIGS. 6 and 8, a circular concave portion 230 is formed in the both side surfaces of the main body portion 226 of the pressure adjustment mechanism forming unit 202, respectively. A space surrounded by the concave portion 230 and the pressure film 227 is set as a liquid storage unit 231. A circular portion corresponding to the concave portion 230 in the pressure film 227 is set as a diaphragm unit 232 which forms a part of the liquid storage unit 231.

As illustrated in FIGS. 6 and 10, the lever unit 205 includes a rectangular plate-like lever 233, a torsion spring 235 which in engaged with an engaging portion 234 of the lever 233. An attachment hole 236 for attaching the lever unit 205 to an attachment portion 218 is formed in a position near the one side rather than the center portion of the lever 233 in a longitudinal direction so as to through the attachment hole. The lever 233 includes a substantially disk-shaped pushing portion 237 in one end portion in a longitudinal direction in a surface of the one side and includes a substantially semispherically pushed portion 238 to the other end portion.

In a case where the lever unit 205 is attached to the attachment portion 218 in the attachment hole 236 of the lever 233, the lever unit 205 is rotatable about a point that is a connection portion of the attachment portion 218 in the lever 233 as a rotating center. In this time, the pushing portion 237 is opposite to the center portion of the diaphragm unit 232 and the pushed portion 238 is contacted in the center portion of the flexible wall 221.

Furthermore, in this time, the urging force of the torsion spring 235 is acted as a resistance force when the pushing portion 237 rotates the lever 233 in a direction approaching the diaphragm unit 232. Therefore, the pushing portion 237 is generally separated from the diaphragm unit 232.

Figure 11:
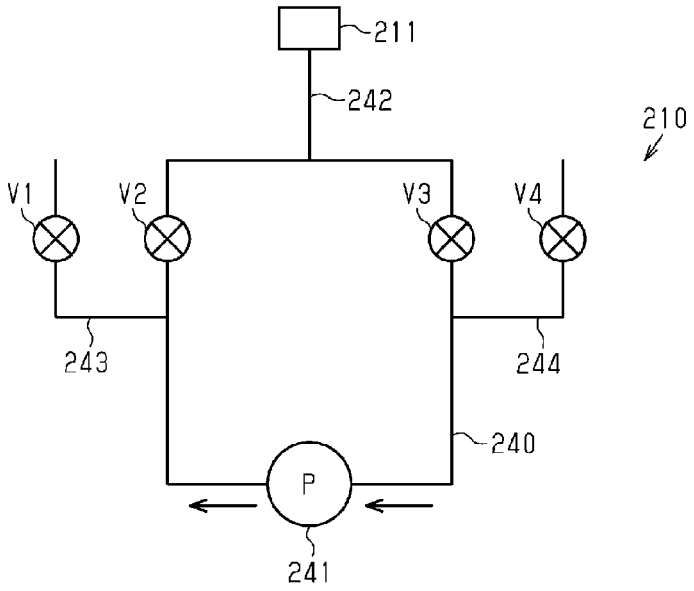
FIG. 11 is a schematic view of the pressure adjustment unit.

As illustrated in FIG. 11, the pressure adjustment unit 210 includes a circular pipe 240, a pump 241 which is provided in the middle of the circular pipe 240, and a connecting pipe 242 which connects the pressure connection portion 211 and the circular pipe 240 which is provided at a position opposite to the pump 241 in the circular pipe 240. A second valve V2 is provided between the pump 241 and the connecting position of the connecting pipe 242 in the circular pipe 240, and a third valve V3 is provided at a position opposite to the second valve V2 in the circular pipe 240.

A base end side of a first branch pipe 243 in which the tip end side is opened to the atmosphere is connected between the pump 241 and the second valve V2 in the circular pipe 240, and a first valve V1 is provided at a middle position of the first branch pipe 243. A base end side of a second branch pipe 244 in which the tip end side is opened to the atmosphere is connected between the pump 241 and the third valve V3 in the circular pipe 240, and a fourth valve V4 is provided at a middle position of the second branch pipe 244.

The pump 241 causes an air to flow in the circular pipe 240 by the driving thereof in one direction indicated by an arrow of FIG. 11. The pressure adjustment unit 210 drives the pump 241 in a state where the first valve V1 and the third valve V3 are closed and the second valve V2 and the fourth valve V4 are opened thereby the air is pressed and supplied from the pressure connection portion 211 and adds the pressure of the pressure adjustment chamber 220 (refer to FIGS. 7 and 8).

On the other hand, the pressure adjustment unit 210 drives the pump 241 in a state where the first valve V1 and the third valve V3 are closed and the second valve V2 and the fourth valve V4 are opened thereby the air is sucked from the pressure connection portion 211 and reduces the pressure of the pressure adjustment chamber 220 (refer to FIGS. 7 and 8).

Accordingly, the pressure adjustment unit 210 serves as a pressing and depressing device which is capable of pressing and depressing of two pressure adjustment chambers 220 (refer to FIGS. 7 and 8) of the pressure adjustment device 200 at the same time. The first to fourth valves V1 to V4 is configured by a magnetic valve, and there opening/closing operation is controlled by the control unit 78 (refer to FIG. 4), respectively.

Next, the pressure adjustment device 200 will be described.

Figure 12:
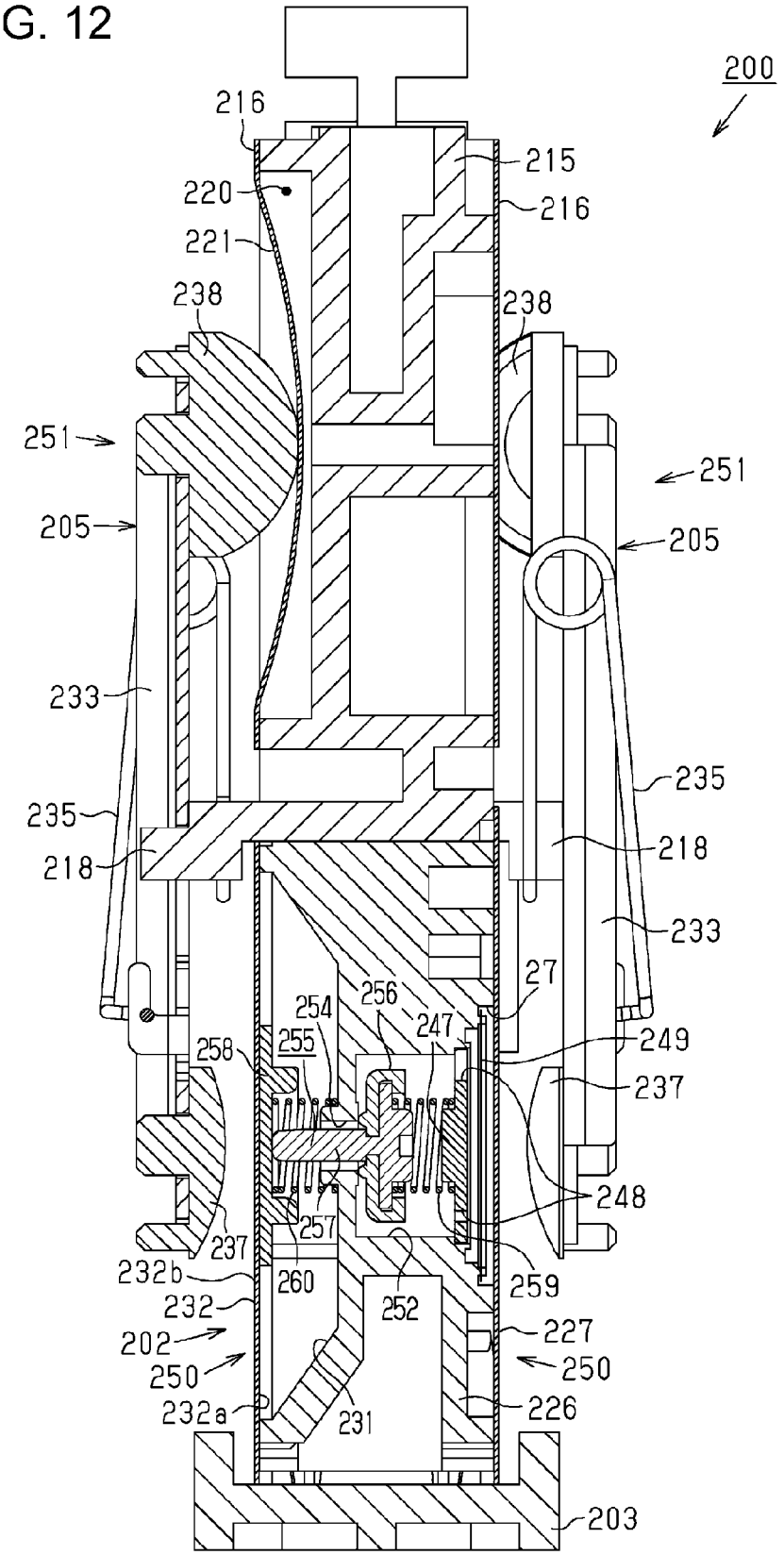
FIG. 12 is a cross-sectional view of the pressure adjustment device in a valve-close state.

Here, it will be mainly described based on the FIGS. 3 and 12. A configuration in which the pressure adjustment device 47 in FIG. 3 is displaced to the pressure adjustment device 200 illustrated in FIG. 12 will be described.

As illustrated in FIGS. 3 and 12, the pressure adjustment device 200 includes a pressure adjustment mechanism 250 which configures a part of the liquid supply path 27 and is provided on the liquid supply path 27, and a pushing mechanism 251 which pushes the pressure adjustment mechanism 250, two by two. Accordingly, the pressure adjustment device 200 can adjust the pressure of two types of the liquids by one pressure adjustment device 200.

The pressure adjustment mechanism 250 included in the pressure adjustment mechanism forming unit 202 includes a liquid inflow portion 252 in which the liquid is supplied form the liquid supply source 13 through the liquid supply path 27 and flows and the main body portion 226 in which the liquid storage unit 231 which is capable of storing the liquid therein. The liquid supply path 27 and the liquid inflow portion 252 are partitioned by a wall portion 247 and are communicated with each other by a through hole 248 which is formed in the wall portion 247. A filter member 249 is disposed at a straight upstream side of the through hole 248 in the liquid supply path 27. Accordingly, a liquid in the liquid supply path 27 is filtered by the filter member 249 and flows into the liquid inflow portion 252.

In the liquid storage unit 231, a part of the will surface is configured by the diaphragm unit 232. The diaphragm unit 232 receives a pressure of the liquid in the liquid storage unit 231 at a first surface 232*a* that is an inner surface of the liquid storage unit 231 and receives an atmosphere pressure at a second surface 232*b* that is an outer surface of the liquid storage unit 231.

Therefore, the diaphragm unit 232 is displaced according to the pressure in the liquid storage unit 231. Accordingly, the volume of the liquid storage unit 231 is changed by displacing of the diaphragm unit 232. The liquid inflow portion 252 and the liquid storage unit 231 are communicated with each other by a communication path 254.

The pressure adjustment mechanism 250 includes an opening/closing valve 255 which is capable of switching a valve-close state (a state illustrated in FIG. 12) to be switched to a non-communication state between the liquid inflow portion 252 and the liquid storage unit 231 in the communication path 254 and a valve-open state (a state illustrated in FIG. 13) to be switched to a communication state between the liquid inflow portion 252 and the liquid storage unit 231.

The opening/closing valve 255 includes a valve portion 256 which is capable of shielding the communication path 254 and a rod portion 257 which is communicated with the communication path 254. The rod portion 257 is in contact with a substantially disk-shaped pressure receiving portion 258 which is disposed such that the tip end thereof is in contact with the center portion of the first surface 232*a* of the diaphragm unit 232. In this case, the pressure receiving portion 258 may be fixed to the tip end of the rod portion 257 and may be fixed to the center portion of the first surface 232*a* of the diaphragm unit 232.

The opening/closing valve 255 is moved by pushing the diaphragm unit 232 through the pressure receiving portion 258. That is, the pressure receiving portion 258 serves as a moveable moving member in a state where the liquid storage unit 231 is in contact with the diaphragm unit 56 displacing to a direction in which the volume of the liquid storage unit 231 is reduced.

An upstream side-urging member 259 is provided in the liquid inflow portion 252 and a downstream side-urging member 260 is provided in the liquid storage unit 231. The upstream side-urging member 259 is pulled in a direction in which the opening/closing valve 255 is closed and the downstream side-urging member 260 pulls the pressure receiving portion 258 to the diaphragm unit 232 side. When a pressure to be applied in the first surface 232*a* is lower than the pressure to be applied in the second surface 232*b* and a difference between the pressure applied to the first surface 232*a* and the pressure to be applied in the second surface 232*b* is equal to or more than a predetermined value (for example, 1 kPa), the state of the opening/closing valve 255 is switched from the valve-close state to the valve-open state.

The predetermined valve is a valve determined in accordance with urging force of the upstream side-urging member 259, urging force of the downstream side-urging member 260, force required for displacing the diaphragm unit 232, pushing force (sealing load) required for shielding the communication path 254 by the valve portion 256, a pressure in the liquid inflow portion 252 to be acted in a surface of the valve portion 256, and a pressure in the liquid storage unit 231. That is, the urging force of the upstream side-urging member 259 and the downstream side-urging member 260 is greater than the predetermined valve as the urging force becomes greater.

The urging force of the upstream side-urging member 259 and the downstream side-urging member 260 is set such that the pressure in the liquid storage unit 231 becomes a negative pressure state in a range in which the pressure in the liquid storage unit 231 is capable of forming the meniscus 64 in an air-liquid interface in the nozzle 19 (for example, in a case where the pressure applied to the second surface 232*b* is an atmosphere, −1 kPa). In this case, the air-liquid interface means an interface in which the liquid is in contact with the air, and the meniscus 64 is a curved liquid surface which is formed by contacting with the nozzle 19. It is preferable that the concave shaped meniscus 64 which is suitable for the injection of the liquid be formed in the nozzle 19.

The pushing mechanism 251 includes the rotatable lever 233 including the pushing portion 237 which is capable of pushing the second surface 232*b* side of the diaphragm unit 232, the pressure adjustment chamber 220 including the flexible wall 221 which applies rotating force to the lever 233, and a pressure adjustment unit 210 (refer to FIG. 7) which is capable of adjusting the pressure in the pressure adjustment chamber 220. The flexible wall 221 is swelled or sunken in accordance with the adjustment of the pressure in the pressure adjustment chamber 220 by the pressure adjustment unit 210 (refer to FIG. 7).

The pressure adjustment unit 210 (refer to FIG. 7) adjusts the pressure in the pressure adjustment chamber 220 to a pressure higher than the atmosphere pressure thereby the flexible wall 221 is swelled. Therefore, by pushing the diaphragm unit 232 by the pushing portion 237 of the lever 233 in a direction in which the volume of the liquid storage unit 231 is reduced, the pushing mechanism 251 set a state of the opening/closing valve 255 to the valve-open state.

That is, when the flexible wall 221 is swelled in a state where the flexible wall 221 is in contact with the pushed portion 238 of the lever 233, the pushed portion 238 is pushed by the flexible wall 221 and the rotating force is applied to the lever 233, and the lever 233 is rotated around a point that is a contact portion of the attachment portion 218 by the rotating force.

The pushing portion 237 pushes the second surface 232*b* side of the diaphragm unit 232 in a direction in which the volume of the liquid storage unit 231 is reduced in accordance with the rotation of the lever 233, there by the state of the opening/closing valve 255 is switched from the valve-close state to the valve-open state. In this time, the pushing portion 237 of the pushing mechanism 251 pushes a region where the pressure receiving portion 258 in the diaphragm unit 232 is contacted. In this case, an area of the region where the pressure receiving portion 258 in the diaphragm unit 232 is contacted becomes greater than a cross-section area of the communication path 254.

In addition, the pressure adjustment unit 210 (refer to FIG. 7) adjusts the pressure in the pressure adjustment chamber 220 to a pressure lower than the pressure in the pressure adjustment chamber 220 during pushing the diaphragm unit 232 by the pushing portion 237 of the lever 233, thereby the pushing mechanism 251 releases the pushing of the diaphragm unit 232 by the pushing portion 237 of the lever 233. In a state where the rotating force due to the flexible wall 221 is not applied to the lever 233, the pushing portion 237 is separated from the diaphragm unit 232.

Next, an action of the pressure adjustment device 200 for adjusting a pressure of the liquid to be supplied to the liquid ejecting unit 12 will be described.

Figure 13:
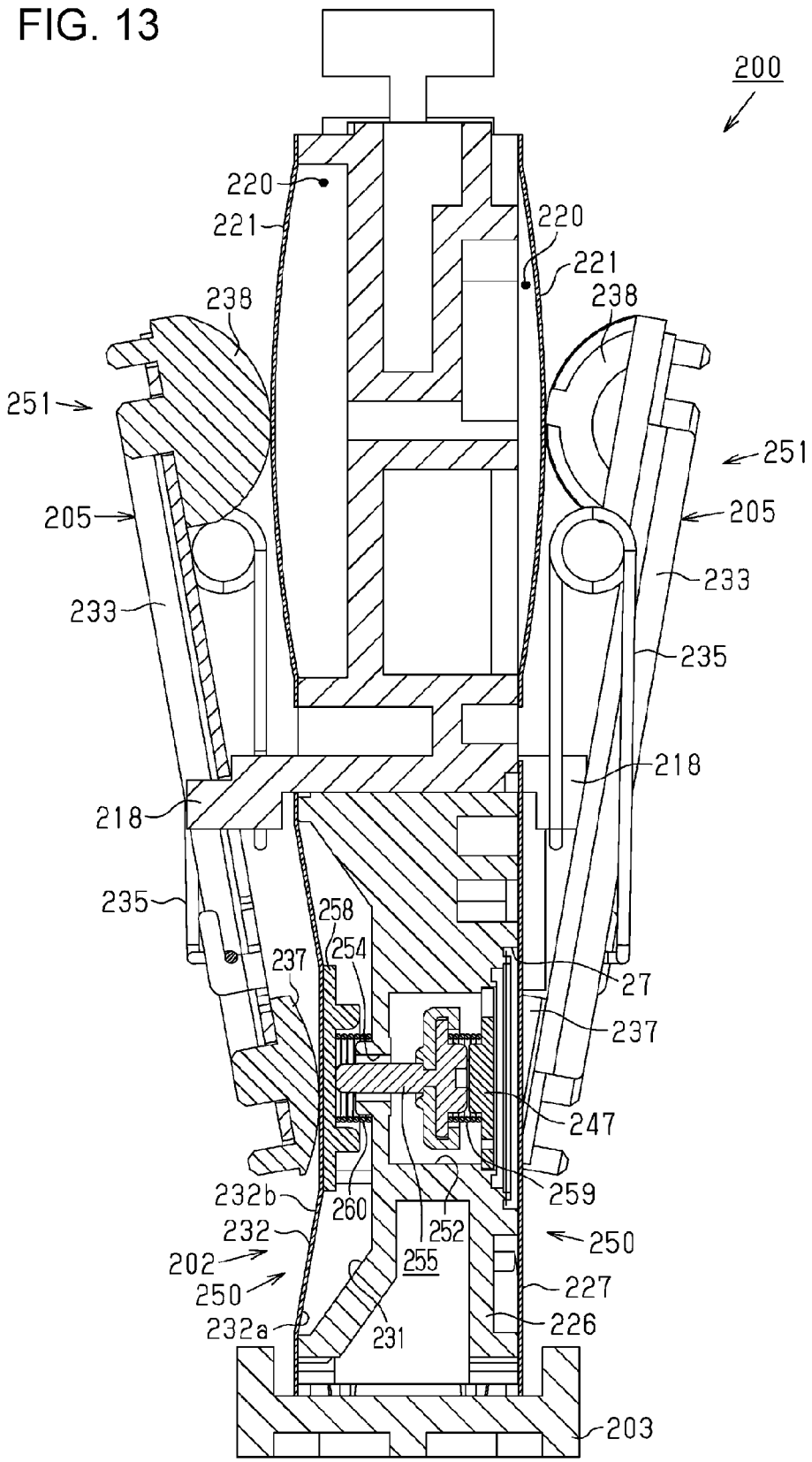
FIG. 13 is a cross-sectional view of the pressure adjustment device in a valve-open state.

When the liquid ejecting unit 12 ejects the liquid, the liquid stored in the liquid storage unit 231 is supplied to the liquid ejecting unit 12 through the liquid supply path 27. In this manner, as illustrated in FIG. 13, when the pressure in the liquid storage unit 231 is reduced and the difference between the pressure to be applied on the first surface 232*a* in the diaphragm unit 232 and the pressure to be applied to the second surface 232*b* is equal to or more than the predetermined value, the diaphragm unit 232 is bent and deformed in a direction in which the volume of the liquid storage unit 231 is reduced. When the opening/closing valve 255 is pushed through the pressure receiving portion 258 and moved in accordance with a deformation of the diaphragm unit 232, the state of the opening/closing valve 255 is switched to the valve-open state.

In this manner, since the liquid in the liquid inflow portion 252 is pressed by the pressure mechanism 31, the liquid is supplied from the liquid inflow portion 252 to the liquid storage unit 231 and the pressure in the liquid storage unit 231 is increased. Accordingly, the diaphragm unit 232 is deformed such that the volume of the liquid storage unit 231 is increased. When the difference between the pressure to be applied to the first surface 232*a* in the diaphragm unit 232 and the pressure to be applied in the second surface 232*b* is smaller than the predetermined value, the opening/closing valve 255 is moved by the urging force of the upstream side-urging member 259 and inhibits the flow of the liquid by switching the state from the valve-open state to the valve-close state.

In this manner, the pressure adjustment mechanism 250 adjusts the pressure of the liquid to be supplied to the liquid ejecting unit 12 by displacing the diaphragm unit 232 thereby the pressure in the liquid ejecting unit 12 that is a back pressure of the nozzle 19 is adjusted.

Next, an action in a case where in order to maintenance of the liquid ejecting unit 12, pressure cleaning is performed by forcibly flowing the liquid from the liquid supply source 13 to the liquid ejecting unit 12.

As illustrated in FIG. 11, when the control unit 78 (refer to FIG. 4) opens the first valve V1 and the third valve V3 of the pressure adjustment unit 210 and drives the pump 241 in a state where the second valve V2 and the fourth valve V4 are opened, the air is suppressed and the supplied from the pressure connection portion 211 and the pressure in the pressure adjustment chamber 220 (refer to FIG. 12) is adjusted to a pressure higher than the atmosphere pressure.

Accordingly, as illustrated in FIG. 13, the flexible wall 221 is swelled and pushes the pushed portion 238 of the lever 233, and the lever 233 is rotated around a point that is a contact portion of the attachment portion 218 by against to the urging force of the torsion spring 235.

In this manner, the pushing portion 237 of the lever 233 pushes the region where the pressure receiving portion 258 in the diaphragm unit 232 is contacted by against to the urging force of the downstream side-urging member 260. In this manner, the opening/closing valve 255 receives the pushing force by the pushing portion 237 through the diaphragm unit 232 and the pressure receiving portion 258 and is moved against to the urging force of the upstream side-urging member 259, and the state of the opening/closing valve 255 is switched to the valve-open state.

That is, the pushing mechanism 251 moves the pressure receiving portion 258 and the opening/closing valve 255 against to the urging force of the upstream side-urging member 259 and the downstream side-urging member 260, the state of the opening/closing valve 255 is switched to the valve-open state. That is, the control unit 78 opens the opening/closing valve 255 by causing the pushing mechanism 251 to push the diaphragm unit 232. In this case, since the pressure adjustment unit 210 is connected to the pressure connection portion 211 of the plurality of pressure adjustment device 200, entire the opening/closing valve 255 of the pressure adjustment device 200 is in the valve-open state.

In this case, since the diaphragm unit 232 is deformed in a direction in which the volume of the liquid storage unit 231 is reduced, the liquid stored in the liquid storage unit 231 is extracted to the liquid ejecting unit 12 side. That is, the pressure obtained such that the diaphragm unit 232 pushes the liquid storage unit 231 is transmitted to the liquid ejecting unit 12 thereby the meniscus 64 is broken and the liquid is leaked from the nozzle 19.

That is, the pushing mechanism 251 pushes the diaphragm unit 232 such that the pressure in the liquid storage unit 231 becomes greater than the pressure (a pressure at the liquid side in the air-liquid interface is a pressure higher at 3 kPa than the pressure at the air side) in which at least one of the meniscuses 64 is broken.

In addition, the pushing mechanism 251 pushes the diaphragm unit 232 thereby the state of the opening/closing valve 255 becomes a valve-open state regardless of the pressure in the liquid inflow portion 252. In this case, the pushing mechanism 251 presses the diaphragm unit 232 by the pushing force greater than the pushing force to be generated in a case where the pressure in which the above-describe predetermined valve is added to the pressure to be applied to the liquid by the pressure mechanism 31 is added to the diaphragm unit 232.

In the valve-open state of the opening/closing valve 255 by pushing the diaphragm unit 232 by the pushing mechanism 251, the control unit 78 periodically drives the decompression unit 43 thereby the liquid pressed by the pressure mechanism 31 is supplied to the liquid ejecting unit 12. That is, when the pressure of the negative pressure chamber 42 is reduced in accordance with the driving of the decompression unit 43, the flexible member 37 is moved in a direction in which the volume of the pump chamber 41 becomes increased.

In this manner, the liquid is flown from the liquid supply source 13 to the pump chamber 41. When the pressure is released by the decompression unit 43, the flexible member 37 is pulled in a direction in which the volume of the pump chamber 41 decreases by the urging force of the urging member 44. That is, a predetermined amount of the liquid in the pump chamber 41 is pressed by the urging force of the urging member 44 through the flexible member 37, is sent to the downstream side of the liquid supply path 27 through the one-way valve 40 which is disposed at the downstream side, and is supplied to the liquid ejecting unit 12.

Since the pushing mechanism 251 maintain the valve-open state of the opening/closing valve 255 during pushing the diaphragm unit 232, when the pressure mechanism 31 presses the liquid in this state, the pressure force is transmitted to the liquid ejecting unit 12 through the liquid inflow portion 252, the communication path 254, and the liquid storage unit 231, and the pressure cleaning in that the liquid is discharged (dropped) from the nozzle 19 is performed. That is, the control unit 78 supplies a predetermined amount of the liquid in a pressed state by pressing the liquid by the pressure mechanism 31 to the liquid ejecting unit 12 and discharges the supplied liquid from the nozzle 19.

When the predetermined amount (a predetermined amount of the liquid in the pump chamber 41) of the liquid is discharged from the nozzle 19, the discharge of the liquid from the nozzle 19 is stopped. That is, when the pressure mechanism 31 discharges (droplets) the predetermined amount of the pressed liquid from the nozzle 19, the level of the pressure of the liquid to be supplied in accordance with the discharge of the liquid is lowered, and becomes a pressure level in which the liquid is not discharged from the nozzle 19.

In this state, the control unit 78 is configured to cause the wiping member 130 to wipe the nozzle forming surface 18 by driving the wiping motor 131. Therefore, the meniscus 64 is formed in the nozzle 19 in a state of an inner pressure state higher than the inner pressure of the liquid ejecting unit 12 at a time of normal meniscus formation. Thereafter, when the control unit 78 opens the first valve V1 and the third valve V3 of the pressure adjustment unit 210 and closes the second valve V2 and the fourth valve V4, the air is sucked from the pressure connection portion 211 and the pressure in the pressure adjustment chamber 220 is reduced.

Therefore, the swelled flexible wall 221 is shriveled into a recessed state. In this manner, the lever 233 is rotated around the point that is a contact portion of the attachment portion 218 by the urging force of the torsion spring 235, and is returned to the original position. That is the pushing portion 237 of the lever 233 becomes a state where the pushing portion 237 is separated from the diaphragm unit 232.

In this manner, the pressure receiving portion 258 and the diaphragm unit 232 are returned to the original position by the urging force of the downstream side-urging member 260 and the opening/closing valve 255 is moved by the urging force of the upstream side-urging member 259 and the state of the opening/closing valve 255 is switched to the valve-close state. That is, the control unit 78 switches the state of the opening/closing valve 255 to the valve-close state by releasing the pushed state of the diaphragm unit 232 by the pushing mechanism 251 in a state where the liquid is pressed at the degree in which the liquid is not discharged from the nozzle 19 by the pressure mechanism 31.

In this time, in a case where the inner pressure of the liquid ejecting unit 12 is reduced by the valve closing operation of the opening/closing valve 255, there is a possibility in that the meniscus 64 in the nozzle 19 is broken and the air or the like is sucked into the nozzle 19. In this feature, in the present embodiment, since the meniscus 64 is formed in the nozzle 19 in a state of an inner pressure state higher than the inner pressure of the liquid ejecting unit 12 during forming normal meniscus as described above, it is suppressed that the meniscus 64 is broken and the air or the like is sucked in the nozzle 19, even when the inner pressure of the liquid ejecting unit 12 is reduced by the valve closing operation of the opening/closing valve 255. Therefore, the pressure cleaning of the liquid ejecting unit 12 is finished, and thereafter, the control unit 78 stops the pump 241 of the pressure adjustment unit 210.

Hereinabove, according to the detailed described second embodiment, the following effects can be obtained.

(12) In the liquid ejecting apparatus 11, the pressure adjustment unit 210 adjusts the pressure in the pressure adjustment chamber 220 and applies the rotating force to the lever 233 by the flexible wall 221, thereby the pushing mechanism 251 rotates the lever 233 to perform the pushing the second surface 232*b* side of the diaphragm unit 232 by the pushing portion 237. Therefore, by only changing a specification of the lever 233 (a lever ratio, a shape, or the like), the pushing force due to the pushing portion 237 can be changed without changing a specification (pressure force, a size, or the like) of the pressure adjustment chamber 220. That is, even when the required pushing force is changed by the pushing portion 237, by only changing the specification of the lever 233, since it can correspond to the change without changing the specification of the pressure adjustment chamber 220, general-purpose properties can be improved.

(13) In the liquid ejecting apparatus 11, in a state where the rotating force due to the flexible wall 221 is not applied to the lever 233, the pushing portion 237 is separated from the diaphragm unit 232. Therefore, a generation of an operation failure of the pressure adjustment mechanism 250 caused by contacting the pushing portion 237 of the lever 233 to the diaphragm unit 232 can be suppressed.

(14) In the liquid ejecting apparatus 11, the pushing mechanism 251 presses the region in which the pressure receiving portion 258 is contacted in the diaphragm unit 232 by the pushing portion 237 of the lever 233. Therefore, the diaphragm unit 232 can be pushed by the pushing portion 237 such that the outer side region (surrounding region) of the pressure receiving portion 258 in the diaphragm unit 232 is not deformed to the liquid storage unit 231 side. After releasing the pushing of the diaphragm unit 232 by the pushing portion 237, since the state of the outer side region of the pressure receiving portion 258 in the diaphragm unit 232 is moved in a direction in which the volume of the liquid storage unit 231 is increased and is returned to a state before the pushing, it is suppressed that the air bubbles or the liquids are sucked from the nozzle 19.

(15) In the liquid ejecting apparatus 11, the pressure adjustment unit 210 adjusts the pressure in the pressure adjustment chamber 220 to a pressure higher than the atmosphere pressure thereby the pushing mechanism 251 pushes the diaphragm unit 232 by the pushing portion 237 of the lever 233. Therefore, by only adjusting the pressure in the pressure adjustment chamber 220 to a pressure higher than the atmosphere pressure, the diaphragm unit 232 can be pushed by the pushing portion 237 of the lever 233.

(16) In the liquid ejecting apparatus 11, the pressure adjustment unit 210 adjusts the pressure in the pressure adjustment chamber 220 to a pressure lower than the pressure in the pressure adjustment chamber 220 during pushing the diaphragm unit 232 by the pushing portion 237 thereby the pushing mechanism 251 releases the pushing the diaphragm unit 232 by the pushing portion 237 of the lever 233. Therefore, a pushed state of the diaphragm unit 232 due to the pushing portion 237 of the lever 233 can be easily released.

(17) In the liquid ejecting apparatus 11, a rotating force applying portion is the flexible wall 221 which forms a part of the pressure adjustment chamber 220 and applies the rotating force to the lever 233 by contacting to the lever 233. Therefore, the flexible wall 221 which forms a part of the pressure adjustment chamber 220 preferably serves as the rotating force applying portion applying the rotating force to the lever 233.

(18) In the liquid ejecting apparatus 11, the pushing mechanism 251 pushes the liquid in the valve-open state of the opening/closing valve 255 by pressing the diaphragm unit 232 thereby the pressure mechanism 31 supplies the liquid in a pressed state to the liquid ejecting unit 12. Therefore, by pressing the liquid by the pressure mechanism 31 in a state where the opening/closing valve 255 is forcibly opened, a so-called pressure cleaning that is a cleaning in which the liquid in a pressed state is supplied to the liquid ejecting unit 12 and discharged from the nozzle 19 can be performed.

(19) In the liquid ejecting apparatus 11, in a state where the liquid is pressed by the pressure mechanism 31, the state of the opening/closing valve 255 is switched to the valve-close state by releasing the pushed state of the diaphragm unit 232 by the pushing mechanism 251. Therefore, it is suppressed that the air bubbles or the liquids is sucked from the nozzle 19 after pressure cleaning.

(20) In the liquid ejecting apparatus 11, the control unit 78 opens the opening/closing valve 255 by pushing the diaphragm unit 232 to the pushing mechanism 251, supplies the liquid in the pressed state which is obtained by pressing the liquid by the pressure mechanism 31 to the liquid ejecting unit 12, discharges the supplied liquid from the nozzle 19, and causes the wiping member 130 to wipe the nozzle forming surface 18. Therefore, after the pressure cleaning in which the liquid pressed by the pressure mechanism 31 is supplied to the liquid ejecting unit 12 and forcibly discharged from the nozzle 19, by performing wiping the nozzle forming surface 18 by the wiping member 130, the meniscus 64 can be formed in the nozzle 19. Accordingly, after performing the pressure cleaning, it can be suppressed that the liquid attached around the nozzle opening in the nozzle forming surface 18 is sucked in the nozzle 19 with foreign matters or air bubbles.

(21) In the liquid ejecting apparatus 11, after the control unit 78 supplies the predetermined amount of the liquid in a pressed state by pressing the predetermined amount of the liquid to the pressure mechanism 31 to the liquid ejecting unit 12 and stops the discharging of the liquid from the nozzle 19, the control unit 78 closes the opening/closing valve 255 by releasing the pushed state of the diaphragm unit 232 to the pushing mechanism 251 after wiping the nozzle forming surface 18 by the wiping member 130.

In general, when the predetermined amount of the pressed liquid is discharged from the nozzle 19, the level of the pressure of the liquid to be supplied in accordance with the discharge of the liquid is lowered, and becomes a pressure level in which the liquid is not discharged from the nozzle 19. In this state, by wiping the nozzle forming surface 18 by the wiping member 130, the meniscus 64 can be formed in the nozzle 19 in a state of an inner pressure state higher than the inner pressure of the liquid ejecting unit 12 during normal meniscus formation. Therefore, in a case where the inner pressure of the liquid ejecting unit 12 is reduced by the valve closing operation of the opening/closing valve 255, it can be suppressed that the meniscus 64 in the nozzle 19 is broken and the air bubbles are sucked in the nozzle 19.

MODIFICATION EXAMPLES

The above-described embodiments may be changed as follows.

Modification Example 1

The pressure cleaning for maintenance of the liquid ejecting unit 12 in the second embodiment may be performed as follows. That is, first, after open the opening/closing valve 255 by pushing the diaphragm unit 232 by the pushing mechanism 251, by pressing the liquid to the pressure pump (pressure mechanism) which is capable of continuously pressing the liquid, the control unit 78 supplies the liquid in the pressed state to the liquid ejecting unit 12 and discharges the supplied liquid from the nozzle 19. After stopping the supply of the liquid in the pressed state to the liquid ejecting unit 12 by closing the opening/closing valve 255 by releasing the pushed state of the diaphragm unit 232 by the pushing mechanism 251, the control unit 78 may causes the wiping member 130 to swipe the nozzle forming surface 18. Therefore, the pressure cleaning is finished. In this manner, when closing the opening/closing valve 255 during discharging the pressed liquid from the nozzle 19, the liquid in a pressed state of the liquid ejecting unit 12 is discharged after closing the opening/closing valve 255 from the nozzle 19, it becomes to a pressure level in which the liquid is not discharged from the nozzle 19. In this state, by wiping the nozzle forming surface 18 by the wiping member 130, the meniscus 64 can be formed in the nozzle 19 in a state of an inner pressure state higher than the inner pressure of the liquid ejecting unit 12 during normal meniscus formation. Therefore, in a case where the inner pressure of the liquid ejecting unit 12 is reduced by the valve closing operation of the opening/closing valve 255, it can be suppressed that the meniscus 64 in the nozzle 19 is broken and the air bubbles are sucked in the nozzle 19.

Modification Example 2

Figure 14:
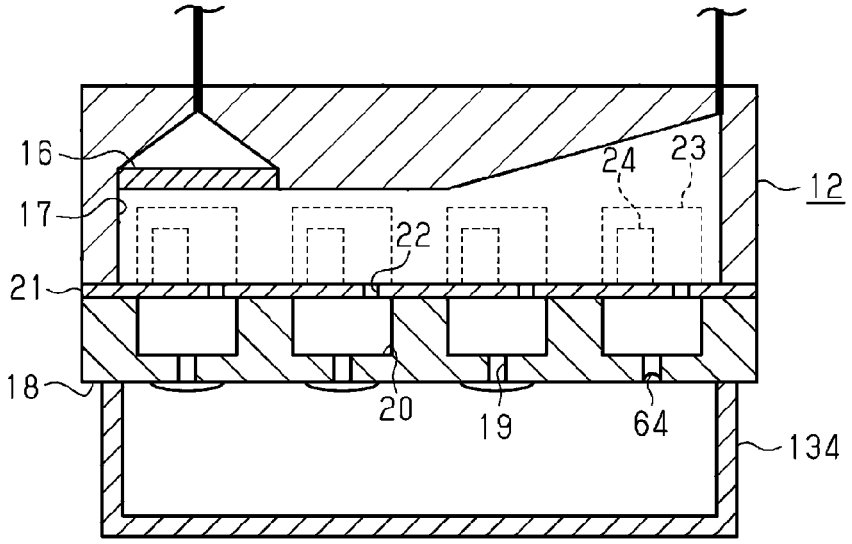
FIG. 14 is an enlarged sectional schematic view of main portions illustrating a state when capping of the liquid ejecting unit is performed, in Modification Example 2.

As illustrated in FIG. 14, in Modification Example 1 above, by pressing the liquid by the pressure mechanism, the control unit 78 supplies the liquid in the pressed state to the liquid ejecting unit 12 and discharges the supplied liquid from the nozzle 19 in a state in which the region including the nozzle 19 in the nozzle forming surface 18 of the liquid ejecting unit 12 is capped with the cap 134. After stopping the discharge of the liquid from the nozzle 19 by closing the opening/closing valve 255, the control unit 78 may causes the wiping member 130 to swipe the nozzle forming surface 18 after releasing the capped state of the region with the cap 134. In this manner, when the liquid is discharged from the nozzle 19 in a state where the region including the nozzle 19 in the nozzle forming surface 18 of the liquid ejecting unit 12 is capped with the cap 134, since the pressure in the cap 134 is increased and is creased higher than the atmosphere pressure, a resistance that impedes the discharging of the liquid from the nozzle 19 is generated. Therefore, the pressure level when the liquid is not discharged from the nozzle 19 becomes greater than a case where the region is not capped. In this state, the air or the like is sucked in the nozzle 19, even when the capping state due to the cap 134 is released. Thereafter, by wiping the nozzle forming surface 18 by the wiping member 130, the meniscus 64 can be formed in the nozzle 19 in a state of an inner pressure state higher than the inner pressure of the liquid ejecting unit 12 during normal meniscus formation. Therefore, in a case where the inner pressure of the liquid ejecting unit 12 is reduced by the valve closing operation of the opening/closing valve 255, it can be suppressed that the meniscus 64 in the nozzle 19 is broken and the air bubbles are sucked in the nozzle 19.

Modification Example 3

Figure 15:
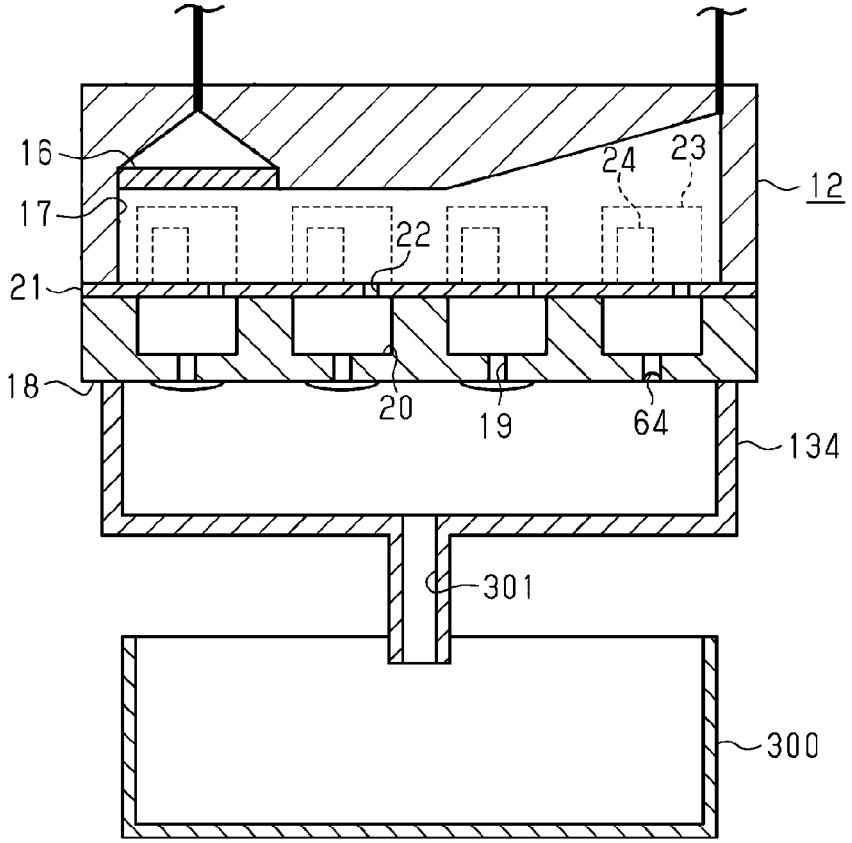
FIG. 15 is an enlarged sectional schematic view of main portions illustrating a state when capping of the liquid ejecting unit is performed, in Modification Example 3.

As illustrated in FIG. 15, in Modification Example 2 above, a discharging flow path 301 for discharging the liquid in the cap 134 to a box-shaped liquid waste collecting container 300 may be provided in the bottom wall of the cap 134. According to this, when the liquid is discharged from the nozzle 19 in a state where the region including the nozzle 19 in the nozzle forming surface 18 of the liquid ejecting unit 12 is capped with the cap 134, by an influence of a flow path resistance when the liquid flows the discharging flow path 301, the pressure in the cap 134 is increased and becomes a pressure greater than the air atmosphere in the same manner as the case of Modification Example 2 above. Therefore, it is possible to obtain the same action effect as Modification Example 2 above.

Modification Example 4

Figure 16:
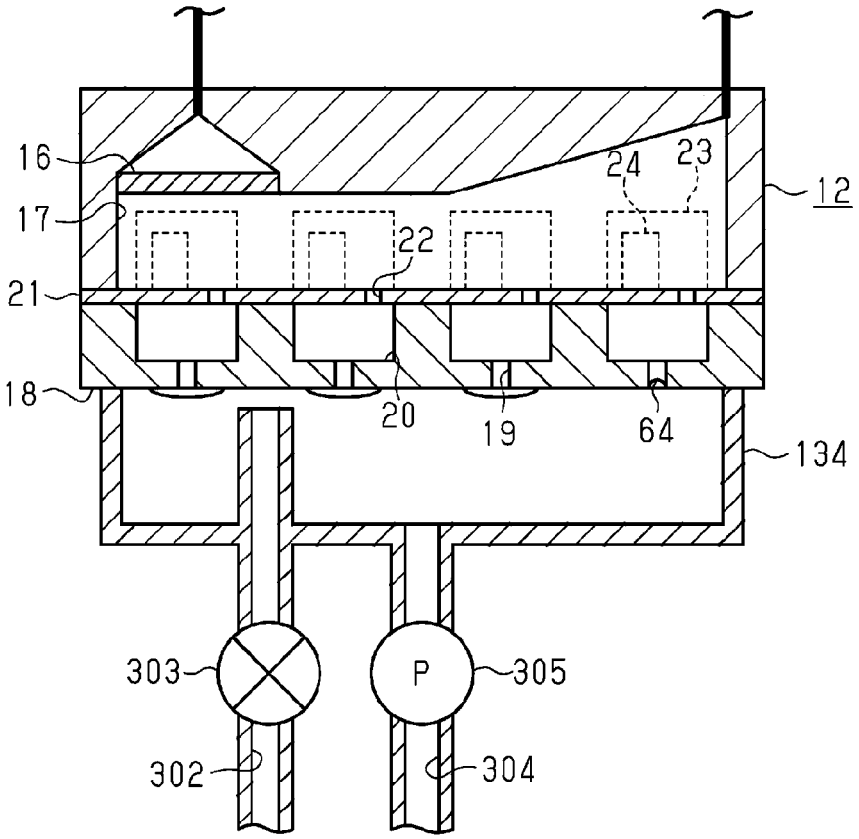
FIG. 16 is an enlarged sectional schematic view of main portions illustrating a state when capping of the liquid ejecting unit is performed, in Modification Example 4.

As illustrated in FIG. 16, in Modification Example 2 above, a communication flow path 302 which communicates the closed space which is formed when capping the region including the nozzle 19 in the nozzle forming surface 18 of the liquid ejecting unit 12 with the cap 134 to the air is provided in a bottom wall of the cap 134. Furthermore, an atmosphere releasing valve 303 which is capable of switching a state between the communication state in which the closed space is communicated to the air and the non-communication state in which the closed space is not communicated to the air may be provided in a middle position of the communication flow path 302. When releasing a certain period of time during discharging of the liquid from the nozzle 19 and the capping state of the region due to the cap 134, the control unit 78 may switch a state of the atmosphere releasing valve 303 from the communication state to the non-communication state. According to this, by discharging the liquid from the nozzle 19 in the communication state of the atmosphere releasing valve 303 and a state where the region including the nozzle 19 in the nozzle forming surface 18 of the liquid ejecting unit 12 is capped with the cap 134, and by switching the atmosphere releasing valve 303 to the non-communication state in the middle, the pressure in the cap 134 can be changed. That is, by changing the timing for switching the atmosphere releasing valve 303 from the communication state to the non-communication state, the degree of an increase in the pressure in the cap 134 can be adjusted. By the way, since the pressure in the cap 134 is changed depending on the discharged amount of the liquid, for example, in a case where the volume of the cap 134 is small and the discharged amount of the liquid to the cap 134 is large, if the timing for switching the state of the atmosphere releasing valve 303 from the communication state to the non-communication state is too early, the pressure in the cap 134 becomes too greater. Therefore, there is a possibility that the liquid in the cap 134 is not discharged from the nozzle 19.

Modification Example 5 as illustrated in FIG. 16, in Modification Example 2 above, a discharging flow path 304 for discharging the liquid in the cap 134 to the bottom wall of the cap 134 is provided and a suction pump 305 which is capable of suction the inside the cap 134 is provided in a middle position of the discharging flow path 304. After performing suction cleaning for discharging the liquid from the nozzle 19 by suction force of the suction pump 305, the pressure cleaning of Modification Example 4 above may be performed in a combination manner.

Modification Example 6

Figure 17:
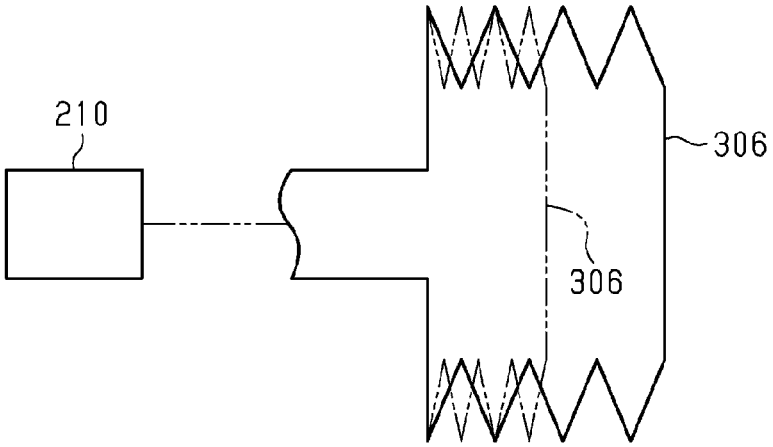
FIG. 17 is a side view of a pushing mechanism of Modification Example 6.

In Modification Example 2 above, as illustrated in FIG. 17, the pressure adjustment chamber and the rotating force applying portion in the pushing mechanism 251 may be configured by an elastic member 306 having a bellows portion which is expanded and contracted by adjusting the pressure in the inner portion by the pressure adjustment unit 210. In FIG. 17, an expanded state of the elastic member 306 is indicated by a solid line, and the contracted state of the elastic member is indicated by a two-dot chain line. Alternatively, the pressure adjustment chamber and the rotating force applying unit in the pushing mechanism 251 may be configured by an air cylinder.

Modification Example 7

In the above-describe second embodiment, for example, the pushing portion 237 of the lever 233, a rotating center of the lever 233, and the pushed portion 238 of the lever 233 may be configured such that the rotating center of the lever 233, the pushing portion 237 of the lever 233, and the pushed portion 238 of the lever 233 are provided in this order. In this case, the pressure adjustment chamber 220 and the flexible wall 221 are disposed in the same side as the above-described second embodiment, the lever 233 is rotated by depressing the pressure adjustment chamber 220 and the diaphragm unit 232 is pushed by the pushing portion 237. Furthermore, in this case, it is required to connect the pushed portion 238 and the flexible wall 221 to each other.

Modification Example 8

In the above-described second embodiment, the rotating force applying portion is not necessarily the flexible wall 221.

Modification Example 9

In the above-described second embodiment, the pressure receiving portion 258 may be omitted.

Modification Example 10

In the above-described second embodiment, in a state where the rotating force due to the flexible wall 221 is not applied to the lever 233, the pushing portion 237 is not necessarily separated from the diaphragm unit 232.

Modification Example 11

In the above-described second embodiment, the pressure receiving portion may be provided in the flexible wall 221.

Modification Example 12

In the above-described second embodiment, the lever 233 is made of metal, the lever 233 may push the diaphragm unit 232 using metal elasticity. According to this manner, the torsion spring 235 can be omitted.

Modification Example 13

In the above-described second embodiment, the opening/closing valve 255 and the pressure receiving portion 258 may be communicated with each other and may be integrally formed.

Modification Example 14

In the above-described second embodiment, the pressure mechanism 31 may be configured by a gear pump, a spring pump, a piston pump, or the like.

Modification Example 15

In the above-described embodiments, the liquid ejecting apparatus 11 may be a liquid ejecting apparatus which ejects or discharges a liquid other than the ink. Moreover, a state of liquid that is discharged as a minute droplet of liquid from the liquid ejecting apparatus is defined as including a granular shape, a tear shape, and a thread shape with a tail. Furthermore, the liquid here may be whatever material can be ejected from the liquid ejecting apparatus. For example, a substance in a liquid phase state may be possible. The substance is defined as including a liquid substance with high or low in viscosity, sol, gel water, other inorganic solvents, an organic solvent, a solution, liquid resin, and a fluidal substance such as liquid metal (metallic melt). Furthermore, the substances are defined as including not only liquid as one phase of the substance but also substances that result from particles of a functional material made from solids such as pigments and metal particles being dissolved, distributed, or mixed in a solvent. As a representative example of the liquid, the ink described above according to the embodiment or liquid dispensed onto a print medium before or after printing with the ink, liquid for humidifying or cleaning a liquid ejecting nozzle of the liquid ejecting apparatus, liquid crystal, and the like are enumerated. As a specific example of the liquid ejecting apparatus, for example, there is a liquid ejecting apparatus that ejects liquid which includes materials in a distributed or dissolved state, such as an electrode material or a coloring material used, for example, in manufacturing a liquid crystal display, an electro luminescence (EL) display, a field emission display, and a color filter. Furthermore, there may be a liquid ejecting apparatus that ejects a living body organic material used in manufacturing a biochip, a liquid ejecting apparatus that ejects liquid that is a specimen used in a precision pipette, a textile printing apparatus, a micro dispenser and others. Moreover, there may be a liquid ejecting apparatus that ejects lubricating oil into a precision machine such as a watch and a camera using a pinpoint, and a liquid ejecting apparatus that ejects transparent resin liquid such as ultraviolet curing resin onto a substrate to form a micro hemisphere lens (an optical lens) used in an optical telecommunication element and the like. Furthermore, there may be a liquid ejecting apparatus that ejects etching liquid such as acid and alkali to etch the substrate and others.

The entire disclosure of Japanese Patent Application No. 2015-247612, filed Dec. 18, 2015, No. 2015-247613, filed Dec. 18, 2015, and No. 2015-234476, filed Dec. 1, 2015, are expressly incorporated by reference herein.

What is claimed is:

1. A liquid ejecting apparatus comprising:

a liquid supply path that is configured to supply a liquid to a liquid ejecting unit which ejects the liquid from a nozzle from a liquid supply source;

a pressure adjustment mechanism which is provided on the liquid supply path and that includes:

a liquid inflow portion for causing entry of the liquid to be supplied from the liquid supply source, a liquid storage part that is configured to store the liquid internally, and in which an inner volume is changed depending on displacing of a diaphragm unit, communication path which brings the liquid inflow portion and the liquid storage part into communication with each other, and an opening/closing valve which is configured to control a state from a valve-close state which is a non-communication state between the liquid inflow portion and the liquid storage part in the communication path to a valve-open state which is a communication state between the liquid inflow portion and the liquid storage part; and an opening valve mechanism which is configured to place the opening/closing valve into the valve-open state;

a pressure mechanism that is connected with an upstream-side liquid supply path that is on the liquid supply source side of the liquid supply path from the pressure adjustment mechanism, the pressure mechanism being configured to pressurize the liquid to be supplied from the liquid supply source to the pressure adjustment mechanism;

a wiping member that is configured to wipe a nozzle forming surface in which the nozzle is formed in the liquid ejecting unit; and a control unit which is configured to open the opening/closing valve by the opening valve mechanism in a state where the liquid in the upstream-side liquid supply path is in a pressurized state by causing the pressure mechanism to supply the liquid in the pressurized state to the liquid to the liquid ejecting unit to discharge the supplied liquid from the nozzle, and cause the wiping member to wipe the nozzle forming surface.

2. The liquid ejecting apparatus according to claim 1, wherein when a pressure applied to a first surface that is an inner surface of the liquid storage part in the diaphragm unit is lower than a pressure applied to a second surface that is an outer surface of the liquid storage part in the diaphragm unit and a difference between the pressure applied to the first surface and the pressure applied to the second surface is a predetermined value or more, the opening/closing valve is switched from the valve-close state to be switched to the non-communication state between the liquid inflow portion and the liquid storage part in the communication path to the valve-open state to be switched to the communication state between the liquid inflow portion and the liquid storage part.

3. The liquid ejecting apparatus according to claim 1, wherein the opening valve mechanism controls the opening/closing valve to the valve-open state by pushing the diaphragm unit in a direction in which the volume of the liquid storage part is reduced.

4. The liquid ejecting apparatus according to claim 1, wherein the pressure mechanism is configured to apply a pressure to a predetermined amount of the liquid, and wherein the control unit is configured:

to supply the predetermined amount of the liquid in the pressurized state, by causing the pressure mechanism to press the predetermined amount of the liquid, to the liquid ejecting unit, to cause the wiping member to wipe the nozzle forming surface after the discharging of the liquid from the nozzle is stopped, and to close the opening/closing valve by releasing the valve-open state of the opening/closing valve through the opening valve mechanism.

5. The liquid ejecting apparatus according to claim 1, wherein the control unit is configured to apply a pressure to the liquid by the pressure mechanism, to discharge the supplied liquid from the nozzle by supplying the liquid in the pressurized state to the liquid ejecting unit, to stop the supplying of the liquid in a pressed state to the liquid ejecting unit by closing the opening/closing valve by causing the opening valve mechanism to release the valve-open state of the opening/closing valve, and to cause the wiping member to wipe the nozzle forming surface.

6. The liquid ejecting apparatus according to claim 5, further comprising:

a cap that is configured to cap a region including the nozzle of the liquid ejecting unit, wherein the control unit is configured to supply the liquid in the pressurized state to the liquid ejecting unit to discharge the supplied liquid from the nozzle in a state where the region is capped with the cap, and to release a capping state of the region due to the cap after stopping of discharging the liquid from the nozzle so as to cause the wiping member to wipe the nozzle forming surface.

7. The liquid ejecting apparatus according to claim 6, wherein the cap includes an atmosphere releasing valve that is configured to switch between a communication state where an enclosed region which is formed when the region is capped is communicated with an air and a non-communication state where the enclosed region is not communicated with the air, and wherein, when releasing a certain period of time during discharging of the liquid from the nozzle and the capping state of the region due to the cap, the control unit is configured to switch a state of the atmosphere releasing valve from the communication state to the non-communication state.

8. The liquid ejecting apparatus according to claim 1, wherein the pressure mechanism includes a pump chamber configured to contain the liquid and is configured to pressurize the liquid in the pump chamber by pressing the pump chamber in a direction in which a volume of the chamber decreases.

9. A maintenance method of a liquid ejecting apparatus which includes:

a liquid supply path that is configured to supply a liquid to a liquid ejecting unit which ejects the liquid from a nozzle from a liquid supply source;

a pressure adjustment mechanism which is provided on the liquid supply path and includes a liquid inflow portion for causing entry of the liquid to be supplied from the liquid supply source, a liquid storage part that is configured to store the liquid internally, and in which an inner volume is changed depending on displacing of a diaphragm unit, a communication path which brings the liquid inflow portion and the liquid storage part into communication with each other, and an opening/closing valve which is configured to control a state from a valve-close state which is a non-communication state between the liquid inflow portion and the liquid storage part in the communication path to a valve-open state to be switched to a communication state between the liquid inflow portion and the liquid storage part; and an opening valve mechanism which is configured to place the opening/closing valve into the valve-open state;

a pressure mechanism that is connected with an upstream-side liquid supply path that is on the liquid supply source side of the liquid supply path from the pressure adjustment mechanism, the pressure mechanism being configured to pressurize the liquid supplied from the liquid supply source to the pressure adjustment mechanism; and a wiping member that is configured to wipe a nozzle forming surface in which the nozzle is formed in the liquid ejecting unit, the method comprising:

opening the opening/closing valve by the opening valve mechanism in a state where the liquid in the upstream-side liquid supply path is pressurized by the pressure mechanism, supplying the pressurized liquid to the liquid ejecting unit and discharging the supplied liquid from the nozzle, and wiping the nozzle forming surface by the wiping member.

10. The maintenance method of a liquid ejecting apparatus according to claim 9, wherein the pressurized liquid is supplied to the liquid ejecting unit, the supplied liquid is discharged from the nozzle, and the opening/closing valve is open by releasing the valve-open state of the opening/closing valve by the opening valve mechanism, and wherein the nozzle forming surface is wiped by the wiping member after stopping the supply of the liquid in a pressed state to the liquid ejecting unit.

11. The maintenance method of a liquid ejecting apparatus which further include a cap that is configured to cap a region including the nozzle of the liquid ejecting unit according to claim 10, wherein the pressurized liquid is supplied to the liquid ejecting unit and the supplied liquid is discharged from the nozzle in a state where the region is capped with the cap, and wherein the capping state of the region due to the cap is released after stopping the discharge of the liquid from the nozzle so as to cause the wiping member to wipe the nozzle forming surface.

12. The maintenance method of a liquid ejecting apparatus according to claim 11, wherein the cap includes an atmosphere releasing valve that is configured to switch between a communication state where an enclosed region which is formed when the region is capped is communicated with an air and a non-communication state where the enclosed region is not communicated with the air, and wherein, when releasing a certain period of time during discharging of the liquid from the nozzle and the capping state of the region due to the cap, a state of the atmosphere releasing valve is switched from the communication state to the non-communication state.

* * * * *